US008448800B2

(12) United States Patent
Konrad

(10) Patent No.: US 8,448,800 B2
(45) Date of Patent: May 28, 2013

(54) METHOD FOR THE ASSEMBLY OF A CAP WITH A RECEPTACLE

(75) Inventor: Franz Konrad, Oberndorf bei Schwanenstadt (AT)

(73) Assignee: Greiner Bio-One GmbH, Kremsmünster (AT)

( * ) Notice: Subject to any disclaimer, the term of this patent is extended or adjusted under 35 U.S.C. 154(b) by 1344 days.

(21) Appl. No.: 10/586,430

(22) PCT Filed: Jan. 14, 2005

(86) PCT No.: PCT/AT2005/000004

§ 371 (c)(1),
(2), (4) Date: Aug. 2, 2007

(87) PCT Pub. No.: WO2005/070781

PCT Pub. Date: Aug. 4, 2005

(65) Prior Publication Data

US 2008/0223815 A1 Sep. 18, 2008

(30) Foreign Application Priority Data

Jan. 23, 2004 (AT) ..... A 80/2004

(51) Int. Cl.

| | |
|---|---|
| ***B67B 1/06*** | (2006.01) |
| ***B65B 51/08*** | (2006.01) |
| ***B65B 7/28*** | (2006.01) |
| ***B65B 3/20*** | (2006.01) |
| ***B65D 41/04*** | (2006.01) |
| ***B65D 41/06*** | (2006.01) |
| ***B65D 41/36*** | (2006.01) |
| ***B65D 53/00*** | (2006.01) |
| ***B65D 43/12*** | (2006.01) |
| ***B65D 43/20*** | (2006.01) |
| ***B65D 41/00*** | (2006.01) |
| ***B65D 41/34*** | (2006.01) |

(52) U.S. Cl.

USPC ..... 215/318; 215/329; 215/341; 220/288; 220/293; 220/299; 220/304; 220/345.1; 53/317; 53/331.5; 53/416; 53/490

(58) Field of Classification Search

USPC ..... 215/329, 341, 318; 220/288, 299, 220/304, 293, 345.1; 53/317, 331.5, 416, 53/490

See application file for complete search history.

(56) References Cited

U.S. PATENT DOCUMENTS 2,048,705 A * 7/1936 Kucera ..... 215/334
2,133,019 A 10/1938 Campbell (Continued)

FOREIGN PATENT DOCUMENTS

DE 30 47 856 9/1981
DE 195 13 453 10/1995

(Continued)

OTHER PUBLICATIONS

Friction Coefficients (http://www.engineershandbook.com/Tables/frictioncoefficients.htm), Accessed Nov. 18, 2009 (copyright 2004-2006).*

(Continued)

*Primary Examiner* — Anthony Stashick
*Assistant Examiner* — Andrew T Kirsch
(74) *Attorney, Agent, or Firm* — Collard & Roe, P.C.

(57) ABSTRACT

The invention relates to a method of assembling a cap (20) of a closure device (9) with an open end (6, 7) of a housing container (5) for forming a container system (1) for body fluids, tissue parts or tissue cultures, whereby a relative rotating or pivoting movement is effected between the cap (20) and the housing container (5) about a common longitudinal axis (14). In order to generate the relative movement, a pressing force (F) is applied to at least one of the components to be assembled directed more or less in the direction of the longitudinal axis (14). The invention further relates to a cap (20) for forming the closure device (9), a housing container (5) and a container system (1) obtained as a result, comprising at least the cap (20), a sealing device (21) device retained in it and the housing container (5).

15 Claims, 18 Drawing Sheets

U.S. PATENT DOCUMENTS

| | | | | | |
|---|---|---|---|---|---|
| 2,187,394 | A | * | 1/1940 | Glocker | 215/262 |
| 3,428,202 | A | * | 2/1969 | Asmus et al. | 215/270 |
| 3,897,337 | A | | 7/1975 | Ayres | |
| 3,897,340 | A | | 7/1975 | Ayres | |
| 3,897,343 | A | | 7/1975 | Ayres | |
| 3,926,401 | A | | 12/1975 | Northup | |
| 3,998,355 | A | * | 12/1976 | Galer | 220/304 |
| 4,079,475 | A | | 3/1978 | Thompson | |
| 4,188,178 | A | | 2/1980 | Anscher | |
| 4,202,769 | A | | 5/1980 | Greenspan | |
| 4,747,498 | A | * | 5/1988 | Gach | 215/232 |
| 4,948,001 | A | | 8/1990 | Magly | |
| 5,275,299 | A | | 1/1994 | Konrad et al. | |
| 5,294,011 | A | | 3/1994 | Konrad et al. | |
| 5,495,958 | A | | 3/1996 | Konrad et al. | |
| 5,522,518 | A | | 6/1996 | Konrad et al. | |
| 5,533,518 | A | | 7/1996 | Vogler | |
| 5,667,870 | A | | 9/1997 | McCullough | |
| 5,687,552 | A | | 11/1997 | Barca | |
| 5,858,141 | A | | 1/1999 | Repp et al. | |
| 5,967,352 | A | | 10/1999 | Repp et al. | |
| 6,006,930 | A | | 12/1999 | Dreyer et al. | |
| 6,017,317 | A | | 1/2000 | Newby et al. | |
| 6,277,331 | B1 | | 8/2001 | Konrad | |
| 6,406,671 | B1 | | 6/2002 | DiCesare et al. | |
| 6,516,953 | B1 | | 2/2003 | DiCesare et al. | |
| 7,188,734 | B2 | | 3/2007 | Konrad | |
| 2001/0055632 | A1 | | 12/2001 | Semersky | |

FOREIGN PATENT DOCUMENTS

| | | |
|---|---|---|
| DE | 296 18 639 | 4/1997 |
| EP | 0 311 011 | 4/1989 |
| EP | 0 419 490 | 4/1991 |
| EP | 0 445 707 | 9/1991 |
| EP | 0 753 741 | 1/1997 |
| EP | 0 867 378 | 9/1998 |
| EP | 0 915 737 | 5/1999 |
| EP | 1 005 910 | 6/2000 |
| EP | 1 106 250 | 6/2001 |
| EP | 1 106 251 | 6/2001 |
| EP | 1 106 252 | 6/2001 |
| EP | 1 106 253 | 6/2001 |
| EP | 1 107 002 | 6/2001 |
| EP | 1 174 084 | 1/2002 |
| EP | 1 174 085 | 1/2002 |
| GB | 2 067 701 | 7/1981 |
| WO | WO 96/05770 | 2/1996 |
| WO | WO 02/078848 | 10/2002 |

OTHER PUBLICATIONS

International Search Report (ISR).

International Preliminary Report on Patentability (IPRP).

* cited by examiner

METHOD FOR THE ASSEMBLY OF A CAP WITH A RECEPTACLE

CROSS REFERENCE TO RELATED APPLICATIONS

Applicant claims priority under 35 U.S.C. §119 of Austrian Application No. A80/2004 filed Jan. 23, 2004. Applicant also claims priority under 35 U.S.C. §365 of PCT/AT2005/000004 filed Jan. 14, 2005. The international application under PCT article 21(2) was not published in English.

BACKGROUND OF THE INVENTION

The invention relates to a method of assembling a cap with one end of a housing container, a cap designed for this method, as well as a housing container and a resultant container system, of the type described as an example of the invention. The invention further relates to a housing container for inserting a separating device in its interior, of the type described as an example of the invention.

Various container systems comprising a housing container and a closure device which can be coupled with it are described in patent specifications EP 0 867 378 A2, EP 1 174 084 B1, EP 1 174 085 B1 and U.S. Pat. No. 6,017,317 A1. In these instances, a coupling mechanism in the form of a thread arrangement between the closure mechanism, in particular the cap, and the end of the housing container to be closed is described, and the thread arrangement has thread segments in the region of the housing container distributed about the circumference, which are respectively spaced apart from one another in the circumferential direction. Disposed in the region of the internal face of the cap is the sealing mechanism comprising several layers, with a layer which can be closed again, a connecting layer between it and a gas barrier element as well as another connecting layer between the gas barrier element and the housing container. The re-closeable element is also glued into the cap by means of a hot-melt adhesive. This being the case, the connecting or retaining force of the other connecting layer between the gas barrier element and the housing container is not as strong as the connecting force of the hot-melt adhesive disposed between the re-closeable element and the cap. In order to guide and pre-position the cap with respect to the threads on the housing container, guide projections are provided inside the cap, which, as viewed in the circumferential direction, are shorter than the gap between the individual threads. The process of joining the cap to the housing container therefore involves imparting a rotating or pivoting movement to the cap.

Other closure mechanisms made by this applicant are known from patent specification EP 0 915 737 B1, for example, in which the conical seal element is inserted in the base region of the housing container and is retained in a clamped arrangement by means of a cap engaging in the outer periphery of the housing container in order to provide an adequate seal. The coupling is obtained on the basis of a pure snap-fit operation between the closure element which is similar to a cap and the housing container.

Another closure device made by this same applicant is disclosed in EP 0 445 707 B1 or U.S. Pat. No. 5,294,011 A, whereby a coupling mechanism is disposed between the cap and the seal element, comprising projections on the internal surface extending in the direction toward the longitudinal axis in the region of the cap and a shoulder projecting alongside the seal stopper. An additional retaining ring is also provided between the flange-shaped shoulder of the seal stopper and the projection of the cap disposed farther away from the housing container. In order to fit or screw the cap on, guide webs or threads are provided on the internal face of the cap, which co-operate with guide projections on the housing container. Accordingly, the cap can be fitted by means of a screwing operation by effecting a relative rotating movement between the cap and the housing container, or simply by pushing the cap over the guide projections on the housing container.

Finally, other closure devices made by the same applicant are disclosed in patent specifications EP 0 419 490 B1, U.S. Pat. No. 5,275,299 A, U.S. Pat. No. 5,522,518 A and U.S. Pat. No. 5,495,958 A. These documents disclose a coupling mechanism between the cap and the housing container on the one hand and another coupling mechanism between the cap and the seal mechanism disposed in it. The coupling mechanism between the cap and the housing container is again provided in the form of guide projections in the region of the housing container and guide webs which can be located with them, for example threads, on the cap internal face. The screwing-on movement is continued until the cap has been fitted far enough onto the open end face of the housing container that the guide projections of the housing container are moved into the free space between the end of the guide web or thread and the end wall of the cap. As a result, the cap can be freely rotated relative to the housing container without the coupling mechanism locating. Again in this instance, the cap can be fitted by a screwing operation or by pushing the cap incorporating the guide web over the guide projection or guide projections on the housing container. This is possible due to the elasticity of the cap.

Patent specification EP 0 753 741 A1 discloses a holder device with a housing container which has two ends spaced apart from one another in a longitudinal axis, at least one of which is provided with an orifice. The internal dimension of the housing container in the region of the first open end in the plane oriented perpendicular to the longitudinal axis is bigger than the internal dimension in the region of the other end in the plane oriented parallel therewith in the same spatial direction. In addition, an annular component is inserted in the open end, which covers the open end face of the housing container with a collar, and a cylindrical wall part projects in at least certain regions into the interior of the housing container. Adjoining the cylindrical wall part, the annular component has a step and a and region which is wider in cross-section region joined to it, on which the elastic seal element of the separating device is supported in the initial position. In the centre, the separating device has a cut-out, which is closed by a thin cover plate in the region of the top end of the housing container. The individual components are assembled and in particular the separating device is inserted in a vacuum chamber because once the separating device has been fitted, it is no longer possible to access the interior without damaging the latter. A film is also glued onto the collar-shaped shoulder of the annular component and a cap is fitted. The interior is filled by piercing the thin cover plate of the separating device, the thin film as well as the cap. During this filling process, a vacuum is created in the interior, as a result of which air is also sucked into the interior. This is followed by a centrifuging operation, during which the separating device moves out of the annular component in the direction of the closed end so that it lies with its seal element also in contact with the internal surface of the housing container. The settlement speed in the mixture and the elements already separated is determined by the contact force of the elastic seal element on the internal surface. Depending on the selected density of the separating device as a whole by reference to the elements in the mixture which have to be separated, the mixture floats at the separation surface between the two media of differing densities. During the centrifuging process, it is possible for the lighter medium to get between the internal surface of the housing container and the elastic seal element.

Another container system with a separating device is disclosed in patent specification EP 1 005 910 A2 and has a cylindrical housing container with a virtually constant internal diameter. Disposed at the open end of the housing container is a closure device which can be pierced, and the separating device is disposed almost in contact with it, including in the initial position. This separating device is made from a flexible rebounding material and a sealing device is provided on the outer periphery of the separating device in order to seal the internal surface of the housing container. In addition, another deformable element is inserted in the interior, which is pressed against the internal wall of the outer housing container due to the pressure exerted by the medium as a result of the centrifugal force and thus forms a flow passage between the separating device and the inserted deformed insert part so that a sealing position in conjunction with the seal elements disposed on the separating device is assumed again once the centrifugal force is switched off, thereby enabling the separated media to be kept separate from one another.

A container system for a mixture of at least two media is also known from patent specification DE 195 13 453 A1, which has a housing container in the form of a test tube closed off by a closure device at an open end region and in which a separating device is inserted for separating the different media of the mixture after the separation process. In order to prevent the end face of the separating device which is subsequently in contact with only one medium from being contaminated as the interior of the container is being filled with the mixture, the middle region of the separating device is provided with an orifice through which the mixture can be introduced into the rest of the interior of the housing container. During the subsequent separation process by centrifugation in the conventional manner using a radial centrifugal force (rcf) of 1,000 g to 5,000 g—where g represents the gravitational force and 1 g is a value of 9.81 m/s.sup.2—one medium separated from the mixture is transferred through the orifice in the separating device into the region disposed between the seal mechanism and the separating device and sinks in the direction of the closed end of the housing container as a result. In order to prevent the other medium disposed between the closed end and the separating device from passing through the orifice after the separation process and intermixing with the other separated medium again, a wider end stop is provided at a height corresponding to the usual remaining quantity of the other medium which is of a conical shape in the direction towards the closed end, by means of which the separating device runs onto the end stop which projects through the orifice. As soon as the external diameter of the end stop corresponds to the internal diameter of the orifice, the separating device remains in this position and the orifice is closed off by the stop as a result so that no exchange or intermixing can take place between the two media again. The disadvantage of this design is that it is necessary to manufacture a tube with an internally lying stop and the function whereby the media are separated is not reliable due to the orifice provided in the separating device. Furthermore, it is quite difficult to insert the separating device in the interior of the housing container subsequently.

Patent specification WO 96/05770 A1 discloses other container systems for centrifuging mixtures containing at least two different media which have to be separated, in which the housing container is closed off by a closure device at both end regions. A separating device in the form of a sealing disc is disposed in the interior and comprises a gel. During the centrifugation process, this gel plug migrates between the two different media separated from one another due to its specific weight, which in higher than the specific weight of the medium having the lower specific weight and lower than the specific weight of the medium with the higher specific weight, due to the centrifugal forces acting on it. Once positioned in this manner, therefore, the one medium of the mixture can be separated from the other. The disadvantage of this approach is that the shelf life is not enough for standard applications in many cases due to the fact that the separating device is provided in the form of a gel.

Other container systems with separating devices fitted in them are provided in the form of various valve arrangements and filter elements, as disclosed in patent specifications EP 0 311 011 A2, U.S. Pat. No. 3,897,343 A, U.S. Pat. No. 3,897,340 A, U.S. Pat. No. 4,202,769 A and U.S. Pat. No. 3,897,337 A.

Yet other container systems incorporating separating devices are known from EP 1 106 250 A2, EP 1 106 251 A2, EP 1 106 252 A2, EP 1 106 253 A2 and EP 1 107 002 A2, which disclose separating devices of various designs based on the principle whereby a component of the separating device deforms during the centrifugation process and on the basis of the density between the media to be separated.

SUMMARY

The underlying objective of the invention is to specify a method of assembling a cap with one end of a housing container, a cap as well as a housing container suitable for this method and a container system assembled by this method, whereby assembly or the joining process is simple and inexpensive in terms of the assembly equipment needed for this purpose. Furthermore, however, the intention is to propose a housing container for making up a container system which, in co-operation with a separating device disposed in it, already makes the filling process easier and thus enables a perfect and permanent separation of the elements of the mixture to be separated with effect from the start of the process of filling the interior of the container system with the mixture already and continuing through until after centrifugation.

This objective is achieved by the invention on the basis of a method of assembling a cap with one end of a housing container. The advantages gained as a result of the combination of features specified reside in the fact that, merely by applying a pressing force (F) directed in the direction of the longitudinal axis of the housing container and the cap in co-operation with the thread arrangement disposed these components of the unit, this axially acting pressing force (F) causes a relative pivoting or rotating movement between these components, thereby resulting in the screwing-on or screwing-in process. As a result, this obviates the need for automatic fitting machines which have otherwise been required in the past to carry out the requisite rotating or pivoting movements. This method proposed by the invention results in a reduction of the cost of the automatic assembly machines because now, only a simple longitudinal movement has to be performed by applying a force accordingly. Further cost savings are achieved due to the amount of space saved and due to the shorter cycle times which can be achieved using this method. Costs incurred for incidental maintenance work and repairs are also r educed as a result of the simplified joining process.

An approach based on some embodiments is also of advantage because the handling involved in the process of joining and assembling the container system is better and simpler.

Since the cap and the housing container are retained in a predefined manner, the housing container and/or optionally the cap can be moved to effect the relative pivoting or rotating movement by applying the pre-definable pressing force (F). Furthermore, it is also possible to place the cap loosely on the housing container, after which the housing container (s) is or are fixedly retained and the cap is then displaced in a rotating movement relative to the housing container when the pressing force (F) is then applied, resulting in the joining operation and, based on an appropriate selection, is so to the stage of being fully screwed on. This enables a plurality of container systems to be screwed, which means that assembly can be performed simply and rapidly with little complexity in terms of machinery.

Another advantageous approach is defined in another embodiment, whereby in co-operation with the coupling mechanism between the cap and the housing container in the form of the thread arrangement, an exactly pre-definable screwing-on movement can be performed. By selecting the intensity of the pressing force and the fitting speed, a clearly pre-definable end position can be obtained between the components to be joined.

Another advantageous approach is defined in another embodiment because a tightly sealed closure device for the housing container can be produced, which involves nothing more than converting a linear movement transmitted to the housing container into a rotating movement.

The approach based on the method step defined in another embodiment enables the axial pressing force to be transmitted uniformly into a rotating movement.

Another approach defined in another embodiment is of advantage because the components to be assembled with or joined to one another always assume the same initial position, which means that it is always possible to achieved a predefined end position.

An approach based on the characterising feature defined in another embodiment is also of advantage because a mutual guiding action is produced during the entire rotating or pivoting movement until the completely screwed-on position is reached and during unscrewing.

Also of advantage is another variant of the method defined in another embodiment, because the pressing force needed for assembly purposes can be reduced or decreased, depending on the coating and selected pitch angle of the mutually engaging threads, thereby making the joining operation more reliable and rapid. However, this also enables the sealing properties between the seal stopper and the housing container to be influenced.

Another approach based on the characterising features defined in another embodiment is of advantage because the coating can be applied selectively depending on the different frictional properties between the components to be joined, which means that the corresponding coefficients of friction can be reduced depending on the mounting point on the basis of an appropriate selection.

Finally, an approach based on the characterising features defined in another embodiment is of advantage because a large number of container systems can be finished in a single operation, which means that a large number of assembled container systems can be produced in short cycle times. Furthermore, less space is required for the common joining operation.

The objective of the invention is also achieved independently on the basis of the characterising features defined in another embodiment. The surprising advantage obtained as a result of the features specified in the characterising part of another embodiment resides in the fact that, based on the selection of the pitch angle in co-operation with the pressing force to be applied, the operation of joining the components to be assembled can be performed merely by applying the axial pressing force (F). Due to the selected pitch angle, the purely axial pressing force is converted into a relative rotating or pivoting movement between the cap and the housing container on the one hand and, on the other hand, allowance is made so that the seal stopper is inserted in the housing container with the correct movement. The exact selection therefore enables the joining or screwing-on operation to be performed easily.

As a result of the embodiment defined in another embodiment, the pitch angle may be varied within broad limits, which means that an exact and fine adjustment can be made depending on the components to be joined.

As a result of the embodiment defined in another embodiment, the screwing-on operation or joining operation can be made easier whilst making a slight saving on material at the same time.

Also of advantage is another embodiment defined in another embodiment, because the cap can be completely screwed or fitted onto the housing container with a shorter pivot angle. Due to the multiple thread arrangement, the pressing force needed for the joining or screwing-on operation can be distributed more efficiently around the entire circumference of the cap and the housing container, thereby resulting in a uniform load on the components to be joined.

Also of advantage is an embodiment as defined in another embodiment, because it also makes pre-centering of the cap relative to the housing container easier and more efficient right from the start of the joining operation.

Due to the embodiment defined in another embodiment, a sufficient pitch angle can be obtained across the height over which the thread extends, which converts the pressing force acting on the cap into a pivoting or rotating movement.

As a result of another embodiment defined in another embodiment, the manufacturing process is made simpler as viewed round the circumference thereby making it easier to remove the cap from the mould.

The embodiment defined in another embodiment is conducive to pre-positioning the cap relative to the housing container and also facilitates the subsequent joining operation.

An embodiment defined in another embodiment is also of advantage because the static and/or sliding friction between the components to be joined can be easily and above all reliably defined for the joining operation beforehand, depending on the selected coating.

As a result of the embodiment defined in another embodiment, the coating can be better adjusted to suit what are preferably different materials engaging with one another, thereby enabling the coefficients of friction to be further reduced and thus further facilitate and simplify the joining operation.

An embodiment defined in another embodiment is of advantage because components with a reduced friction can be retained at the relevant point inside the cap in readiness so that they are not actually employed until the first joining operation, for example. This enables a predefined positioning inside the cap at various points.

As a result of the embodiment defined in another embodiment, the lubricant or a lubricant additive can be incorporated or introduced into the material used for the cap and distributed accordingly at least across the entire surface of the cap, thereby obviating the need to apply an additional coating.

The embodiment defined in another embodiment is of advantage because the selected slight surface roughness between the co-operating portions of the thread arrangement enables the friction and hence the associated pressing force (F) needed for the joining operation to be reduced.

As a result of the embodiment defined in another embodiment, the sealing device can be retained in the cap correctly positioned by the coupling mechanism, making it possible to run a common operation of joining the cap incorporating the sealing device to the end of the housing container to be closed in a single work step.

Also of advantage is an embodiment defined in another embodiment because, in the region of the cap, parts of the coupling mechanism for retaining the sealing device inside it can be produced, thereby ensuring that the cap is prevented from inadvertently working loose from the sealing device during the joining operation and during subsequent handling procedures needed for the intended application.

As a result of the embodiment defined in another embodiment, an even more efficient coupling and hence more reliable retaining system can be obtained between the sealing device and the cap. Furthermore, because the shoulder of the sealing device extends out from the external cap casing, the entire container system is prevented from rolling, for example on a support surface, during its intended use.

Finally, an embodiment of the cap based on the characterising features defined in another embodiment is also of advantage because handling of the closure device is improved when removing it from the housing container on the one hand and support for the entire container system is improved when it is in a position deposited on a support surface.

Also of advantage is an embodiment defined in another embodiment, because the shoulder of the sealing device also moves into a sealing contact in the region of the end face of the housing container facing it and the seal surface in the region between the internal wall of the housing container and the seal surface of the stopper inserted in the interior can be reduced.

The objective of the invention is also independently achieved by the characterising features defined in another embodiment. The advantage obtained as a result of the features specified in the characterising part of this embodiment resides in the fact that, due to the selected pitch angle and the associated spacing, the start of the thread to the thread end as viewed in the direction of the longitudinal axis can be exactly fixed in a predefined manner so that the joining operation is achieved by applying an exclusive pressing force which is converted or transferred into a relative rotating or pivoting movement between the components to be joined.

As a result of this embodiment, the pitch angle may be varied within broad limits and an exact adjustment made to cater for the components to be joined.

As specified in this embodiment, one part of the thread arrangement is provided on the housing container and whilst making a slight saving on material at the same time, a saving on weight is also achieved, which facilitates the screwing-on or joining operation.

As a result of the embodiment defined in this embodiment, a complete screwing-on or fitting operation of the cap on the housing container can be achieved with a shorter pivot angle. As a result of the multiple thread arrangement, the pressing force needed for the joining or screwing-on operation can also be better distributed around the entire circumference of the cap and the housing container, thereby resulting in a uniform load on the components to be joined.

Also of advantage is an embodiment defined in this embodiment, because it enables the cap to be centred relative to the housing container more easily and more effectively right from the start of the joining operation.

By virtue of one embodiment defined in this embodiment, a thread arrangement is obtained whereby, as viewed across the circumference, the individual threads extend across only a part-region of the circumference and a pre-definable gap is left free between the threads. As a result of this embodiment, it is possible to dispose the dividing plane of the mould for forming the threads alongside the latter and the mould dividing plane can be disposed so that it extends obliquely between them at the mutually spaced points in the region of the gap due to the fact that the ends of the threads and the starting points of the thread are offset due to the pitch. This makes the structure of the mould simpler and thus makes the opening movement easier. Due to the multiple arrangement of the cavities on a narrower space, further production and manufacturing costs can be saved on the moulds.

In this respect, an embodiment defined in this embodiment has proved to be of advantage because misalignment and jamming are prevented during the joining operation in the region of the coupling mechanism between the cap and the housing container.

Due to one advantageous embodiment defined in this embodiment, mutual jamming between the individual threads is prevented during the fitting or screwing-on operation.

Also of advantage is an embodiment wherein the cap can be fitted on the housing container without requiring a high degree of complexity for pre-positioning purposes, after which the joining operation up to the point at which the end position is reached can be easily run.

In one embodiment, the relative rotating movement achieved as a result of the pressing force (F) introduced is also made easier.

At least one embodiment affords a better guiding action, especially during the process of screwing the cap of the housing container.

Other possible embodiments are such that whereby the process of converting the axial force into the rotating movement during the screwing-on operation is made easier and co-operation with the thread arrangement in the cap is improved.

Another possible embodiment is when the cap is being screwed off, the seal stopper is also completely removed from the housing container. In addition, handling during assembly does not have any detrimental effect.

As a result of the embodiment, results in pre-positioning of the cap relative to the housing container is made easier, which also facilitates the subsequent joining operation.

Also of advantage is an embodiment wherein, because based on the selection of coating, the static and/or sliding friction between the components to be joined can be easily and above all reliably defined for the joining operation beforehand.

The advantage of one embodiment is that the process of inserting the stopper of the sealing device in the interior of the housing container can be made significantly easier.

Another embodiment enables the coating on what are preferably different materials engaging with one another to be more accurately formulated, so that the coefficients of friction can be further reduced, thereby facilitating and simplifying the joining operation still further.

Another embodiment enables a further reduction in the coefficients of friction even before the joining operation, which may obviate the need for applying a subsequent coating.

Also of advantage is one embodiment wherein even from the starting position or initial position of the separating device, a predefined retaining force for the separating device to be inserted in the interior can be guaranteed even before the start of the centrifugation process and thus also during the filling process.

An improved fixing of the separating device which can be re-positioned relative to the housing container is advantageously achieved in the region of the operating position as a result of another embodiment. This being the case, the separating device preferably moves into abutment by means of its end region facing the other end of the housing container or alternatively also with the sealing device on it with a positioning device in the form of a stop surface when the predefinable operating position is reached. This reliably prevents any further movement and hence any associated and undesirable intermixing in all situations.

Another embodiment can be formed so that due to the selection of the size of the taper or reduction in the internal cross-sectional dimension of the housing container, the predefinable displacement path of the separating device as far as its operating position can be fixed, in which an all-round continuously extending sealed separation is achieved between the interior disposed between the separating device and the closed end respectively between the separating device and the open end of the housing container.

The objective of the invention may also be independently achieved on the basis of another embodiment. The surprising advantage achieved as a result of the features specified in this embodiment which resides in the fact that by providing at least one flow passage between the internal face of the container wall of the housing container and the insertable separating device, a flow connection is established between the part-portion of the interior on either side of the separating device to be inserted, namely between the separating device and the closed end of the housing container and between the separating device and the end which can be closed off by the closure device. This means that a container system can now be obtained, comprising the housing container and the closure device with a separating device inserted in it, which, right from the filling stage during its intended use—such as collecting a blood sample for example—enables residual quantities of air to flow out from the interior disposed underneath the separating device into the interior disposed above it on the one hand and, on the other hand, also enables part-quantities of the substance with which the interior is to be filled to flow through this or these flow passages. This opposing flow through the flow passage may also take place simultaneously. This enables a so-called shift of residual quantities of air between the two portions on either side of the separating device to be easily monitored in order to facilitate the process of filling with the substance to be contained, in particular blood, still further.

With another embodiment, a minimum flow cross-section is fixed which, in terms of the sub-stance to be filled through it, in this particular instance blood, is sufficient in size and has an appropriate cross-section to prevent blood from remaining in the flow passage due to the surface tension intrinsic to the blood and its density during the filling process.

Another embodiment results in at least one flow passage which permits unobstructed insertion of the separating device in the interior in its initial position, without unintentionally causing wear which might otherwise occur.

Another embodiment provides an adequate seal for the entire container system, including the region where the seal stopper is inserted.

Another embodiment results in whereby a perfect seal is obtained for the part-chambers of the interior disposed on either side of the separating device, even when the separating device is in the operating or separating position.

With another embodiment, depending on the selected wall thickness of the housing container wall, including the region of the cut-out of the housing container, a sufficient permeability is achieved, thereby guaranteeing as long as possible a storage time before use or employment in the intended application.

With another embodiment, the fact that several cut-outs are provided results in a bigger flow volume and by opting for an appropriate relative disposition with respect to one another, the filling process can take place regardless of position without having to use a specific orientation.

With another embodiment, due to a flat or rounded transition from the base surface to the inner surface of the housing container in the region lying closer to or directed towards the open end face, the housing container is easier to remove from the mould during the manufacturing process. Opting for rounded or flat boundary or transition surfaces and thus avoiding sharp edges prevents erythrocytes from bursting, as this would otherwise distort subsequent analysis or prevent it altogether. By designing and disposing the boundary surfaces or transition surfaces accordingly, blood cells are likewise prevented from being deposited so that no residues will be left in the region of the cut-outs.

Another embodiment provides an additional retaining mechanism whilst simultaneously forming the flow passage or passages in co-operation with the separating device to be inserted in the housing container. The parallel disposition also causes a straight flow of quantities of residual air on the one hand and the substance—in particular blood—being introduced on the other hand.

With another embodiment, at least certain regions of the surface structure cause the substance being introduced to roll off the structured surface, and the surface structure is provided either in a waved shape in the nanometre or micrometre range or by additional micro-particles or nano-particles embedded or incorporated in the material of the housing container. This largely prevents adhesion and as a result distortion to the subsequent analysis process.

Another embodiment provides that in combination with an appropriate selection of the pitch angle, the joining operation to the cap can be operated by applying an exclusive pressing force and converting it into a relative rotating or pivoting movement between the components to be joined.

With another embodiment the advantages obtained as a result of the combination of features reside in the fact that, because of the combination of the cap with the housing container, the joining operation and hence the complexity involved in assembly can be made significantly simpler, as a result of which assembly machinery that would otherwise be needed in order to produce the relative rotating or pivoting movement between the components to be joined can be dispensed with. The cycle times are also faster and a higher output achieved, which enables additional savings to be made.

With another embodiment the additional coating significantly facilitates insertion or turning of the stopper of the sealing device into the interior of the housing container, thereby enabling pressing forces to be minimised.

With another embodiment, because selecting an appropriate negative pressure assists suction of the substance with which the interior is being filled, in particular blood, in a known manner, during the removal process, which means that friction losses that would otherwise occur can be compensated, resulting in an efficient filling process.

With another embodiment the process of inserting the seal stopper in the cap from this end is made much easier because the radially projecting shoulder of the seal stopper has to be compressed to only a minimum degree for the seal stopper to be reliably retained in the cap.

With another embodiment, because the cap is guided relative to the housing container as it is positioned on the one hand and the shoulder of the sealing device can additionally be moved onto the end face of the housing container to obtain a sealing contact on the other hand.

With another embodiment, an advantage because when the threads are still engaged, the movement whereby the cap is removed from the housing container together with the sealing device is assisted and a pressure compensation can already take place at the same time between the interior of the housing container and the external ambient atmosphere without aerosols being transferred to the persons handling the system. The latter are directed away between the external surface of the housing container and the internal surface of the cap casing.

With another embodiment, the stopper of the sealing device to be inserted in the interior can already be disengaged from the housing container even though the threads are still engaged, making handling of the entire container system safe.

With another embodiment, the screwing-off path and the associated axial displacement of the seal stopper in the direction of the longitudinal axis is minimised to the degree that at least one passage is formed but the threads of the thread arrangement are nevertheless still mutually engaged.

With another embodiment, because a sufficient contact or seal surface can be obtained between the inserted stopper and the internal wall of the housing container.

With another embodiment it is possible to use the same seal stopper as that used previously but design the passage so that it forms the flow connection between the interior and the external ambient atmosphere whilst using the thread arrangement proposed by the invention.

With another embodiment, because an adequate sealing surface can be maintained between the sealing device and the housing container on the one hand and, on the other hand, a flow connection can be established between the interior of the housing container and the external ambient atmosphere even though the threads are still engaged.

With another embodiment, a more effective coupling can be obtained and hence a more robust retaining system between the sealing device and the cap. Furthermore, because the shoulder of the sealing device extends out from the external cap casing, the container system as a whole is not able to roll off a flat support surface, for example, when being used in its intended application.

With another embodiment, because an additional anti-rotation locking system is provided between the shoulder of the seal stopper and the cap, as a result of which a joint movement can be achieved in order to fit the entire closure device on the housing container.

BRIEF DESCRIPTION OF THE DRAWINGS

The invention will be explained in more detail with reference to examples of embodiments illustrated in the appended drawings. Of these.

DETAILED DESCRIPTION

Figure 1:
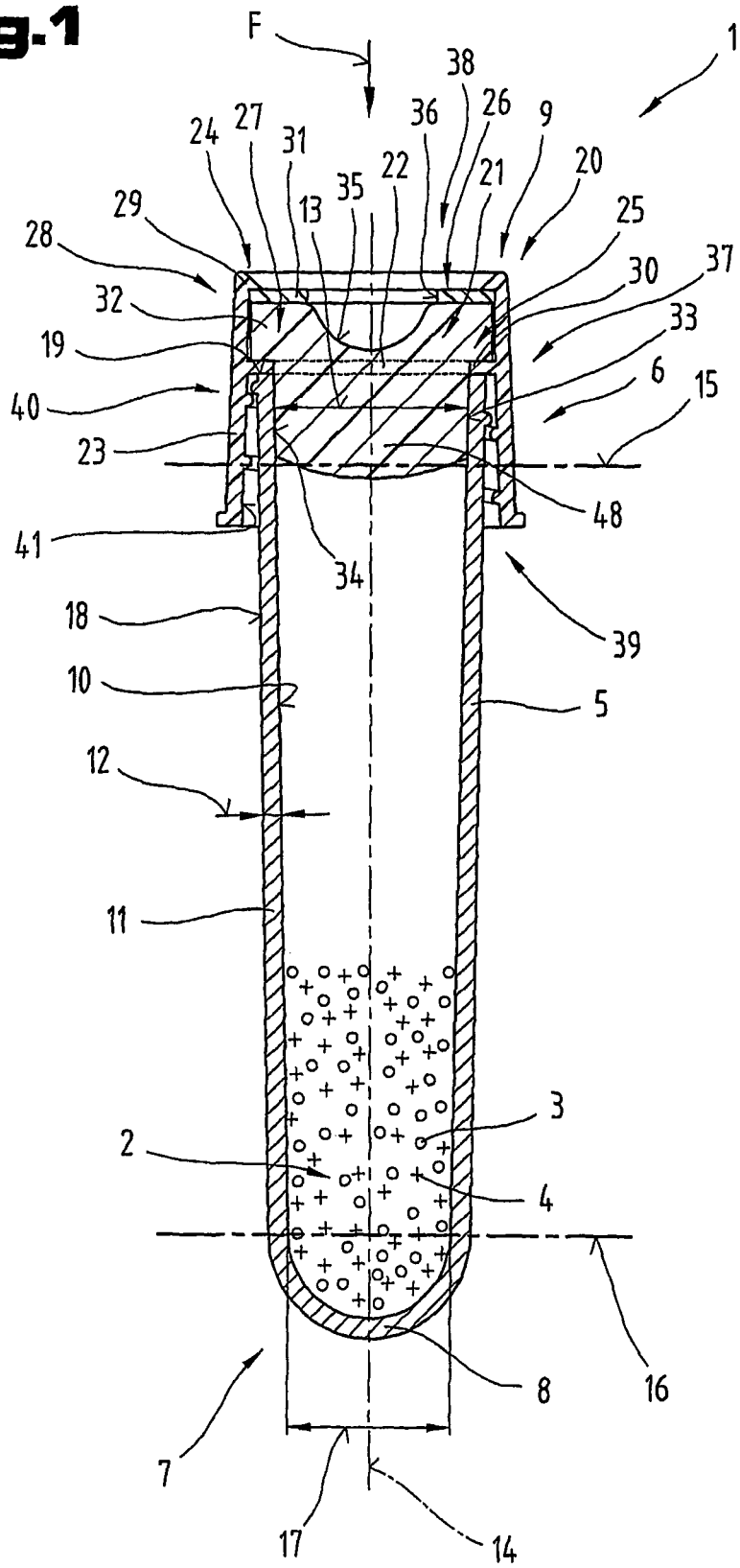
FIG. 1 is a simplified schematic diagram showing a view in section of a container system proposed by the invention, comprising a housing container with a fully fitted closure device.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIGS. 1 to 9 illustrate a container system 1, e.g. for a mixture 2 of at least two different constituents or media 3, 4, such as body fluids, tissue parts or tissue cultures, for example.

The container system 1 consists of a more or less cylindrical housing container 5 with two mutually spaced apart ends 6, 7, and in the embodiment illustrated as an example, the end 6 is open and the end 7 is closed off by an end wall 8. The open end 6 can be closed off by means of a closure device 9 which is illustrated on a very simple basis, and may be of the type disclosed in patent specifications EP 0 445 707 B1, EP 0 419 490 B1, U.S. Pat. No. 5,275,299 A, U.S. Pat. No. 5,495,958 A and U.S. Pat. No. 5,522,518 A for example, and in order to avoid repetition, reference may be made to these for details of the design of the cap, sealing device, the housing or housing container, the coupling mechanism between the cap and sealing device as well as the cap and the housing container 5 and the disposition of the retaining ring, which are included in this application by way of reference. A separating device may also be inserted in an interior 10 enclosed by the housing container 5, although this is not illustrated in detail here. The method by which the closure device 9 and the housing container 5 are assembled or fitted will be described in more detail below. This housing container 5 with the closure device 9 may be designed or used as an evacuated tube for holding blood samples and may be of various different designs.

The housing container 5 may be provided in the shape of a bottle, vial, flask or similar, for example, and may be made from various different materials, such as plastic or glass for example. If plastic is selected as the material for the housing container 5, it may be fluid-tight, in particular waterproof, and optionally also gas-tight, and may be polyethylene terephthalate (PET), polypropylene (PP), polyethylene (PE), polystyrene (PS), high-density polyethylene (PE-HD), acrylonitrile butadiene styrene copolymers (ABS) or similar or a combination thereof. The housing container 5 also has a container wall 11 with a wall thickness 12, and the container wall 11 extends from one end 6 with an internal dimension 13 in a plane 15 oriented perpendicular to a longitudinal axis 14 extending between the two ends 6, 7 to another dimension 17 smaller than it in the region of the end 7 and disposed in another plane 16 extending parallel with the first plane 16. The housing container wall 11 of the housing container 5 has an internal surface 18 facing the interior 10 and an external surface 18 remote from it, which therefore constitutes an external circumference for the housing container 5. As a result of the internal surface of the housing container wall 11 with the internal clearance dimension 13, 17, an internal cross-section is formed which may be of various different cross-sectional shapes, such as circular, elliptical, oval, polygonal, etc. The shape of the external cross-section may also be circular, elliptical, oval, polygonal, etc., and it is also possible for the shape of the external cross-section to be different from the shape of the internal cross-section.

It is of advantage if the internal dimension 13 of the housing container 5, starting from one end 6 through to the other end 7 spaced at a distance apart from it, is such that it becomes constantly smaller to a minimum degree towards the internal dimension 17, because if the housing container 5 is made from plastic by an injection moulding process, this will make it easy to remove it from the injection mould. This conical taper between the two planes 15, 16 predefines the degree of reduction in the internal dimension starting from what is in this instance the bigger dimension 13 through to the smaller dimension 17. The taper or cone angle is between 0.1.degree. and 3.0.degree., preferably between 0.6.degree. and 1.0.degree. by reference to the oppositely lying internal surfaces of the housing container 5. At this stage, it should be pointed out that the described dimensions relate to the distance between the oppositely lying internal and external surfaces 18 of the components, the diameter, the circumference along a casing or casing line and the cross-section or cross-sectional surface respectively in a plane oriented perpendicular to the longitudinal axis 14 and always relate to the same spatial direction with regard to the dimensions 13, 17.

As may also be seen from this diagram, the end 6 has an open end face 19, which can be closed off by a closure device 9, which can be opened again as and when necessary. To this end, the closure device 9 comprises a cap 20 enclosing the open end face 19 and a sealing device 21 retained in it, for example a seal stopper 22 made from a highly elastic and self-closing material which can be pierced, such as a pharmaceutical rubber, silicone rubber or bromobutyl rubber for example. This cap 20 is usually disposed concentrically with the longitudinal axis 14 and is formed by a circular cap casing 23. Disposed between the cap 20 and the sealing device 21 are coupling means, for example coupling parts 24 to 27 of a coupling mechanism 28, comprising, in the case of the cap 20, projections 29, 30 on at least some regions of the internal circumference, optionally a retaining ring 31, and, in the case of the sealing device 21, comprising shoulders 32 projecting from at least certain regions of its external circumference.

In the embodiment illustrated as an example here, the sealing device 21 is formed by the seal stopper 22 and has a circumferentially extending sealing surface 33 disposed more or less concentrically with the longitudinal axis 15, which sits against the internal surface of the housing container 5 when in the sealing position in the portion of the end 6. In this portion, therefore, the internal surface of the housing container 5 should be designed as a sealing surface 34 in terms of its quality. The sealing device 21 also has another sealing surface oriented more or less perpendicular to the longitudinal axis 14, which, in co-operation with the sealing surface 33 lying against the internal surface or sealing surface 34, seals or closes off the interior 10 of the housing container 5 at its open end face 19 with respect to the ambient environment. Due to the projection 30 disposed in at least certain regions between the shoulder 32 projecting out from the sealing surface 33 and the open end face 19 of the housing container 5, any sticking or firm adhesion of the shoulder 32 directly on the end face 19 is avoided.

It may be preferable for the sealing device 21 to have a recess 35 on the side facing the retaining ring 31, which has a cross-sectional surface more or less identical to an orifice 36, the dimensions of this orifice 36 being such that they enable a cannula, not illustrated, to be introduced unobstructed so that the sealing device 21 can then be pierced.

The shoulder 32 of the seal stopper 32 forming the coupling part 26, which projects out in a flange-type arrangement from at least part-regions of the sealing surface 33, is retained between the projections 29 and 30 and optionally the retaining ring 31, which are disposed in two planes oriented in the direction of the longitudinal axis 14 spaced at a distance apart from one another and perpendicular to these oriented planes, and are provided in the form of at last intermittently extending or circumferentially extending annular projections or stop projections for example, forming a groove-shaped region on the internal face of the cap casing 23 for accommodating the shoulder 32 of the seal stopper 22. In order to retain the sealing device 21 reliably in the cap 20, it is also possible to insert the retaining ring 31 between the shoulder 32 and the projection 29 spaced at a greater distance apart from the housing container 5. Accordingly, the retaining ring 31 has a bigger external diameter than an internal dimension between the projections 29 and 30 in the direction perpendicular to the longitudinal axis 14. Likewise, the diameter of the orifice 36 of the retaining ring 31 is smaller than the biggest external diameter of the shoulder 32 in a plane perpendicular to the longitudinal axis 14. However, this external dimension of the sealing device 21 is such that it is bigger than the internal dimension 13 of the internal cross-section and hence the interior 10 by at least twice the wall thickness 12 of the housing container 5. Since the projection 30 forming the coupling part 25 has an internal orifice width which essentially corresponds to the internal dimension 13 of the housing container 5 at its top end 6, the shoulder 32 is very efficiently retained in the cap 20 and a good seal is provided between the interior 10 of the housing container 5 and the atmosphere surrounding the container system 1. However, this internal orifice width may be selected so that it is bigger than the internal dimension 13 of the housing container 5, in which case the projection 30 may lie laterally against the external surface 18 of the housing container 5.

Above all, the seal of the closure device 9 for the open end face 19 of the container system 1 can be further improved if an external diameter of the sealing device 21 in the region of its sealing surface 33 in the relaxed state outside the housing container 5 is bigger than the internal dimension 13 of the housing container 5 in the region facing the sealing device 21.

Also in the relaxed, non-assembled state, a longitudinal or height extension of the shoulder 32 of the sealing device 21 in the direction of the longitudinal axis 14 is bigger than a distance of a groove-shaped seating region or a groove-shaped recess between the two projections 29, 30 and optionally minus a thickness of the retaining ring 31. Due to the dimensional differences between the groove-shaped seating region or the groove-shaped recess and the longitudinal dimensions of the shoulder 32 and the thickness of the retaining rings 31 in the direction of the longitudinal axis 14 described above, the shoulder 32 is clamped between the two projections 29, 30. This simultaneously results in a seal and a clamping of the sealing device 21 with respect to the cap 20 and additionally results in a firm seat for the retaining ring 31 and a tight abutment of the two end faces of the shoulder 32 in the region of the two projections 29, 30.

It is also of advantage if the cap casing 23 is provided in the form of a frustoconical casing or a casing with a truncated cone shape, thereby ensuring that the cap casing 23 is enclosed in the region of the top end face 19.

In addition to the coupling mechanism 28 between the cap 20 and the seal stopper 22 described above, another coupling mechanism 37 is provided between the housing container 5 and the cap 20, although this is only schematically indicated. A detailed description of the parts making up the coupling mechanism 37 will be given with reference to the subsequent drawings.

The cap 20 has two end regions 38, 39 spaced apart from one another in the direction of the longitudinal axis 14 and in the embodiment illustrated as an example, the open end region 39 is disposed so that it extends over the open end face 19 of the housing container 5 and an end face 19 extends close to or even so that it abuts with the projection 30. In the position illustrated here, the end face 19 lies tightly against the surface of the projection 30 facing it. In order to achieve this abutting or almost abutting position, a thread arrangement 40 is also provided between the cap 20 and the housing container 5. A first part of the thread arrangement 40 extends on an internal surface 41 of the cap casing 23 and a second part of the thread arrangement 40 extends on the external surface 18 of the housing container 5. At this stage, it should be pointed out that the thread arrangement 40 and the parts comprising it are only schematically illustrated in this drawing.

In the case of the previously known coupling mechanisms between the cap 20 and the housing container 5, parts of a thread arrangement 40 were known both in the region of the internal surface 41 of the cap casing 23 and in the region of the external surface 18 of the housing container 5, and the cap 20 and closure device 9 were assembled with the housing container 5 and engaged with one another either by transmitting and applying a radial force to the cap 20 and/or the housing container 5 about the longitudinal axis 14 or by a simple pushing-on operation in the direction of the longitudinal axis 14. In the case of the first joining option whereby a radial force acts on the cap 20 and the housing container 5, a rotating motion is generated, thereby resulting in a relative axial movement by the thread arrangement 40 in the direction of the longitudinal axis 14 during the screwing-on operation. Accordingly, the rotating movement was continued until the open end face 19 had moved into the position in the interior of the cap 20 illustrated in FIG. 1. With this briefly described assembly process, it was always necessary to apply a radial force to at least one of the components to be assembled, generating the associated rotating movement about the longitudinal axis 14 in order to bring about the screwing-on effect.

The other joining option described, namely the mutual fitting of the closure device 9, in particular the cap 20, over the open end face 19 of the housing container 5, works due to the elasticity of the cap 20 or cap casing 23, likewise enabling the thread arrangements 40 to be engaged with one another, although it was not possible to achieve a perfect, complete end positioning of the cap 20 relative to the housing container 5 in all situations. In addition to pushing or screwing the cap 20 onto the housing container 5, the seal stopper 22 of the sealing device 21 is always inserted in the open region of the interior 10 thereof. This produces the aforementioned sealing of the interior 10 with respect to the external ambient environment in the region between the sealing surface 33 of the seal stopper 22 and the internal surface of the interior 10.

The disadvantage of the two joining options described above is that in order to screw or turn the cap 20 onto the housing container 5, a radial force has to be applied or when pushing the cap 20 over the threads, the cap or closure device 9 does not assume the fully fitted end position in all cases due to the elastic deformation of the cap 20 or cap casing 23 or the threads can even be damaged.

Figure 2:
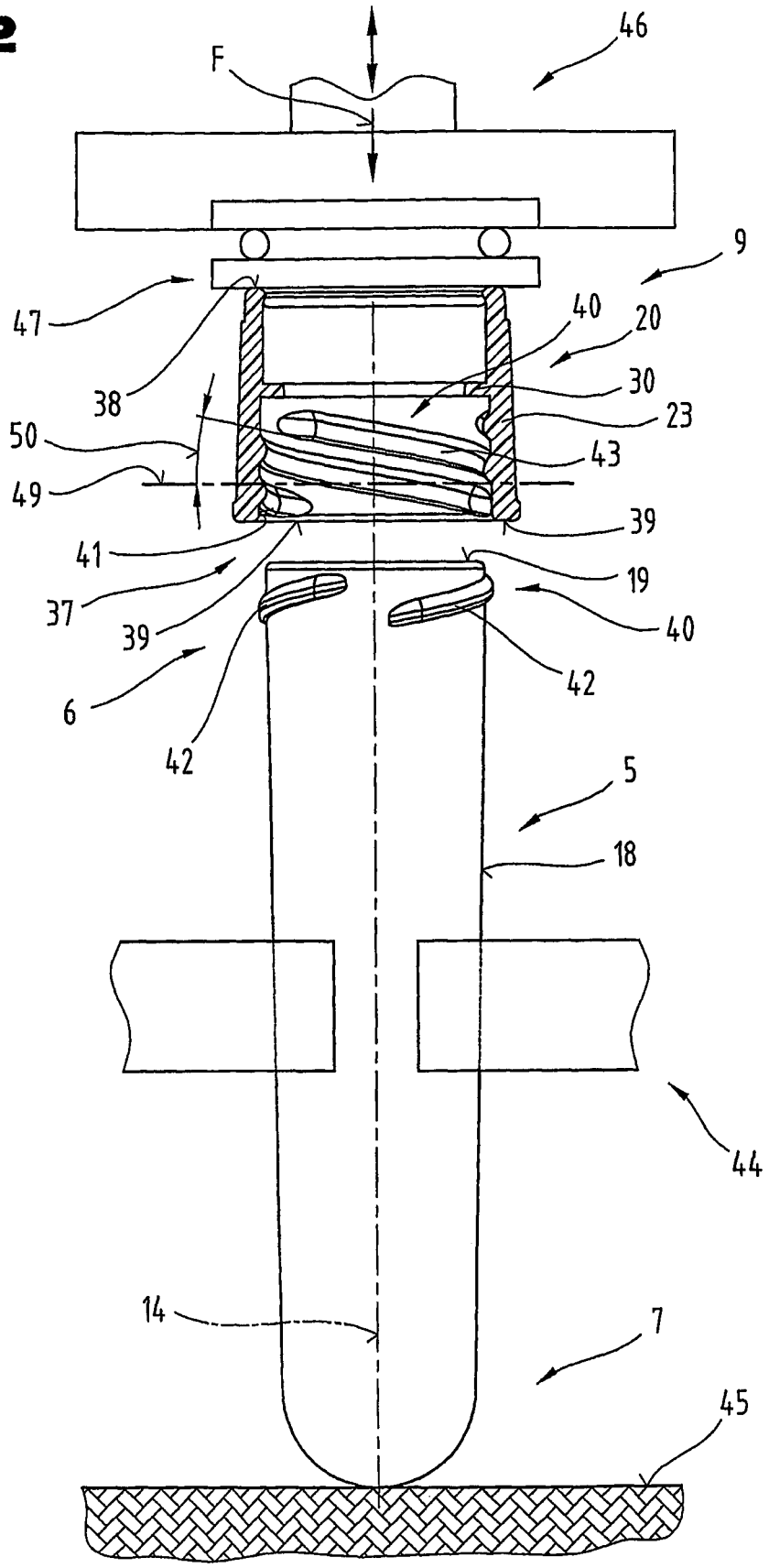
FIG. 2 is a simplified, schematic diagram showing a view in partial section of the housing container and the cap with the seal stopper removed, in the region of a production or joining unit, in a position separated from one another.

FIG. 2 illustrates the components shown in FIG. 1 which have to be assembled in order to form the container system 1, namely the closure device 9 with what is in this instance the open end 6 of the housing container 5, still in a position separated from one another, and, to avoid repetition, reference may be made to the more detailed description of the individual components given with reference to FIG. 1. The same component names are used for parts that are the same as those described in connection with FIG. 1.

The simplified diagram shows a first part of the thread arrangement 40 in the region of the open end face 19 of the housing container 5, such as a thread 42. Disposed in the cap 20, illustrated in half-section, on its internal surface 41 between the end region 39 facing the housing container 5 and the projection 30, is another part of the thread arrangement 40, for example another thread 43, which is also illustrated in a simplified format.

The housing container 5 is preferably held in the vertical position illustrated by means of a retaining mechanism 44, also illustrated in a simplified format, and the closed end 7 of the housing container 5 may be supported on a support surface 45, illustrated in a simplified format.

In this diagram of the cap 20, the seal stopper 22 has been omitted for the sake of clarity in order to make the thread arrangement 40, in particular the thread 43 illustrated here, more clearly visible. For the assembling or joining operation, the cap 20 with the seal stopper 22 in it can be fitted on what is in this instance the open end 6 of housing container 5 by means of devices and mechanisms, such as automatic assembly machines or similar standard production equipment, known from the prior art, although these are not illustrated here.

Also illustrated in a simplified format above the cap 20 is part of an assembly unit 46, which is designed so that it can be displaced in the direction of the longitudinal axis 14 as indicated by the double arrow in the direction towards the housing container 5 and in the opposite direction by means of one or more displacement mechanisms, not illustrated, via positioning means, in terms of its position relative to the housing container 5, which is held stationary. This assembly unit 46 may be provided in the form of an appropriate pressure plate, which can be displaced by known positioning means, such as a cylinder-piston system, spindle drives, gear mechanisms, magnetic or hydraulic drives, etc., so as to effect the predefinable movement. The system may be designed to handle a single container or a plurality.

Disposed between the assembly unit 46, in particular the pressure plate, and the end region 38 of the cap 20 remote from the housing container 5 is another thrust bearing 47, illustrated in a simple format, by means of which it is possible to apply the pressing force via the positioning means and the assembly unit 46 onto the cap in co-operation with the threads 42, 43 of the thread arrangement 40 in order to move the cap 20 and generate a rotating or pivoting movement relative to the housing container 5, thereby resulting in the joining operation or assembly of the closure device 9 with the housing container 5. This being the case, several of these thrust bearings 47 may be retained in an appropriate layout on the pressure plate so that, in the case of a corresponding multiple disposition of units for the container system 1 to be assembled, the joining or assembly operation can be carried out with less space.

Applying a pure pressing force in the direction of the longitudinal axis 14 and converting this pressing force via the co-operating parts of the thread arrangement 40 causes the relative rotating or pivoting movement, thereby screwing the closure device 9 onto the housing container 5.

In the embodiment illustrated as an example here, the threads 42 project out from the external surface 18 of the housing container 5 towards the direction remote from the longitudinal axis 14. The first threads 43 of the thread arrangement 40 project in the region of the internal surface 41 of the cap 20 or cap casing 23 in the opposite direction, in other words starting from the internal surface 41 in the direction towards the longitudinal axis 14. In the joined or assembled position, the individual co-operating threads 42 and 43 mutually engage.

During this fitting operation, care must still be taken to ensure that the seal stopper 22, not illustrated here, with its stopper 48 to be inserted in the interior 10, or as may be seen from FIG. 1 already inserted, always assumes a sealing position relative to the housing container 5. Care must also be taken to ensure that the sealing surface 33 of the stopper 48 is always perfectly retained so that it projects alongside the shoulder 32 inside the cap 20.

As described above, the stopper 48 of the seal stopper 22 inserted in the interior 10 has a bigger external dimension in its relaxed state than the housing container 5 in the insertion region and when selecting the pressing force to be applied, allowance must be made for overcoming the resistance generated by the friction between the stopper 48 and the internal wall of the interior 10. As a result, the pressing force needed to generate the relative rotating or pivoting movement between the closure device 9 and the housing container 5 should have a value of between 10 N and 50 N.

In order to make the insertion movement easier, it is of advantage if, prior to the assembly process, a coating, not illustrated, is applied to at least one component making up the container system 1, at least in certain areas in the region of the coupling mechanism 37. For example, this coating may be applied to the part of the thread arrangement 40 disposed on the housing container 5, and/or to the part of the thread arrangement 40 disposed in the cap 20 and/or to at least one of the mutually facing sealing surfaces 33, 34 in the region of the stopper 48 or housing container 5. The purpose of this coating is to reduce friction between the co-operating components. Accordingly, it is possible to select different coatings in the region of the thread arrangement 40 and between the seal stopper 22 and the housing container 5.

The coating may be applied to at least one component forming part of the container system 1 (closure device 9 with cap 20 and sealing device 21 or housing container 5). It is preferably applied in at least certain areas of the region of the coupling mechanism 37, in which case it may be applied to the part of the thread arrangement 40 disposed on the housing container and/or in the cap 20. A coating may be provided not only on the threads 42, 43 of the thread arrangement 40 but also on at least certain areas of the internal surface 41 of the cap casing 23 and/or at least certain areas of the external surface 18 of the housing container 5 at least in the region of the thread arrangement 40. However, this coating may also be applied to the internal surface 18 of the housing container 5 facing the sealing surface 33 of the stopper 48 of the sealing device 21. It is also of advantage if the coating is applied continuously or uninterrupted, preferably with a pre-definable coating thickness.

Prior to applying the pressing force (F), one of the components to be assembled (closure device 9, in particular the cap 20, or housing container 5) should be pre-positioned relative to the other one of the components to be assembled (housing container 5 or closure device 9, in particular the cap 20) by a free rotation about the common longitudinal axis 14. This is done by gripping one of the two components so that they are mutually oriented in co-operation with the threads 42, 43, thereby guaranteeing a perfectly repeatable screwing-on operation as far as the end position. During the relative rotating or pivoting movement about the common longitudinal axis 14, the threads 42, 43 of the thread arrangement 40 engage across the entire length of the screwing-in movement until the fully screwed-on position has been reached.

If the cap 20 and the sealing device 21 inserted in it were merely pushed with the housing container 5 onto one another in a purely axial movement only, it would not be possible to achieve an exact mutual orientation of the threads 42, 43 and this could cause the threads 42, 43 to lie on or over one another in the plane oriented perpendicular to the longitudinal axis 14 due to the elastic widening of the cap casing 23. The disadvantage of this is that the cap casing 23 sits on the housing container 5 with a stronger radial clamping force due to the widening so that the closure device 9 is released from the housing container 5 in a saccadic movement, as a result of which the mixture 2 or media 3, 4 contained in the interior can unintentionally escape.

The coating used to facilitate the insertion movement of the seal stopper 22 of the sealing device 21 might be silicone oils, wax, wax-type polymers, fatty alcohols, fatty acid esters, fatty acid amides, for example. However, it would also be possible to incorporate or introduce lubricants or lubricant additives to the coating and apply it to the cap 20 and/or the housing container 5 and/or the sealing device 21 in order to reduce frictional forces. Accordingly, the coating contains at least one lubricant or one lubricant additive. Irrespective of this, however, it is also possible to incorporate at least one lubricant or one lubricant additive in the mixture or granulates used to produce the cap 5, in which case the lubricant will melt or soften together with the mixture or granulate to form the molten plastic in a known manner so that the lubricant is already a constituent element of the cap material.

The coating and/or the lubricant additives or lubricant incorporated or introduced or dissolved in it may be formulated so that the sliding friction between the components to be joined is sharply reduced but also the static friction is increased, with a view to preventing any unintentional loosening of the components during their intended use. It is also possible to achieve a specific opening movement of the closure device 9, in particular the cap 20, from the housing container 5, which makes subsequent access to the interior 10 easy, for example when taking a sample from the collected medium.

As illustrated in a very simplified manner. the region of the internal surface 41 of the cap 20 where the thread 43 is disposed has a pitch angle 50 with respect to a plane 49 perpendicular to the longitudinal axis 14 which is selected from a range with a lower limit of 2.degree., preferably 3.degree., in particular 5.degree., preferably of 8.degree., 10.degree., 13.degree., 15.degree., and with an upper limit of 30.degree., preferably 25.degree., in particular 20.degree., preferably of 16.degree., 13.degree. respectively 12.degree. Tests have shown that a pitch angle 50 with a value of 9.degree., 10.degree. or 11.degree., 12.degree. is of advantage.

Irrespective of the above, it would also be possible for the assembly unit 46 and the pressing force to act not on the cap 20 but on the closed end 7 of the housing container 5 and conversely to hold the cap 20 stationary and turn the housing container 5 by means of the thread arrangement 40 under the effect of the generated pressing force applied to the housing container 5 into the intended position in the cap 20.

Instead of the assembly or joining operation described with reference to FIG. 2, however, a different principle may be applied, as will be briefly explained below with reference to FIG. 10.

Figure 3:
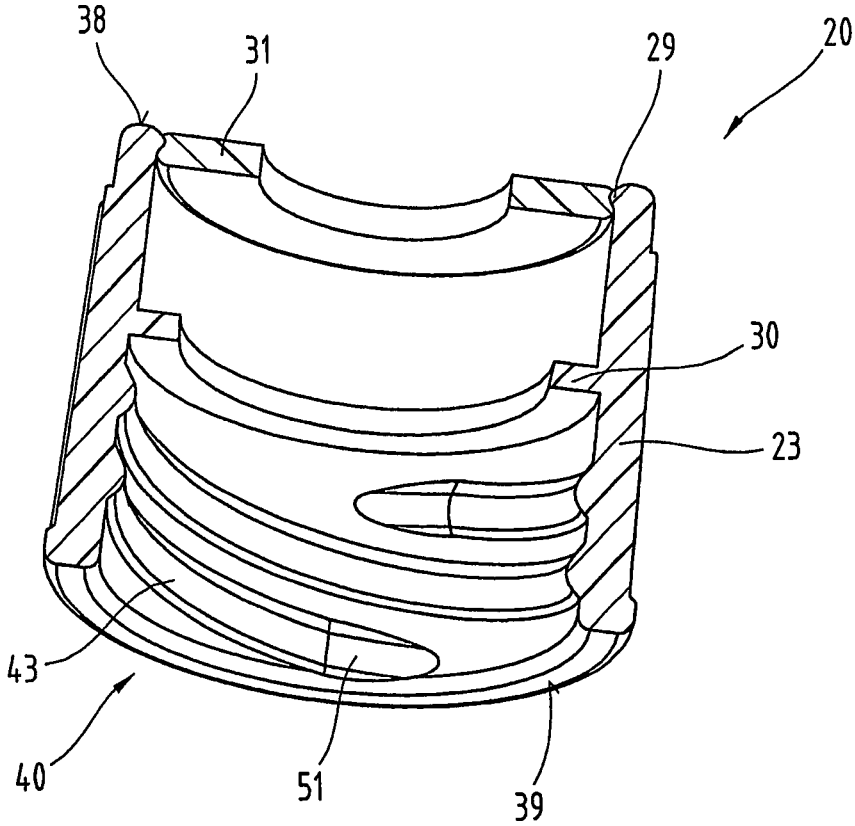
FIG. 3 is a simplified diagram in section illustrating the cap proposed by the invention.
Figure 4:
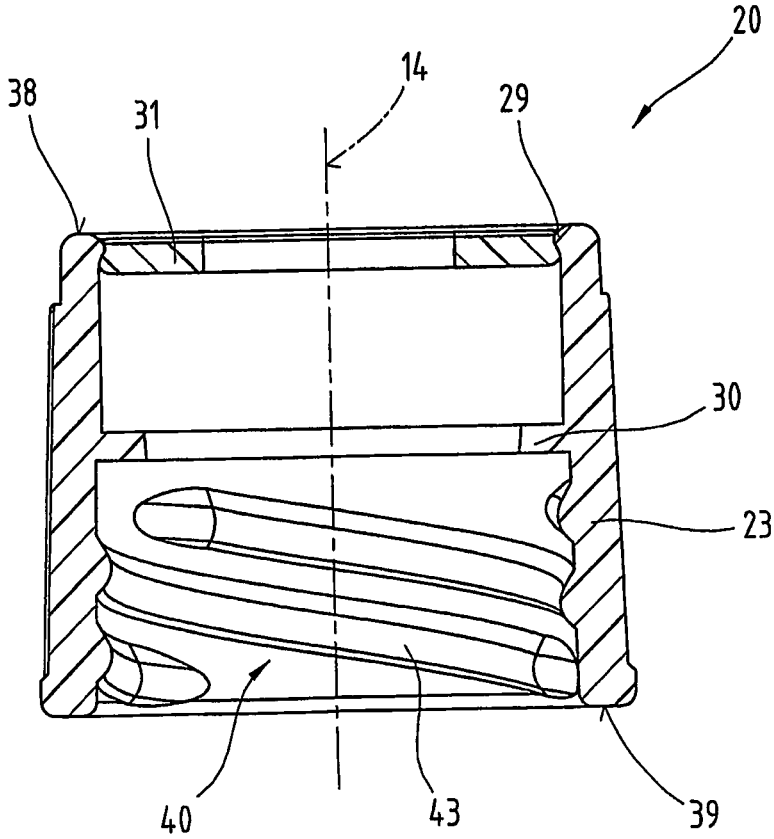
FIG. 4 is a view showing the cap illustrated in FIG. 3 in section.
Figure 5:
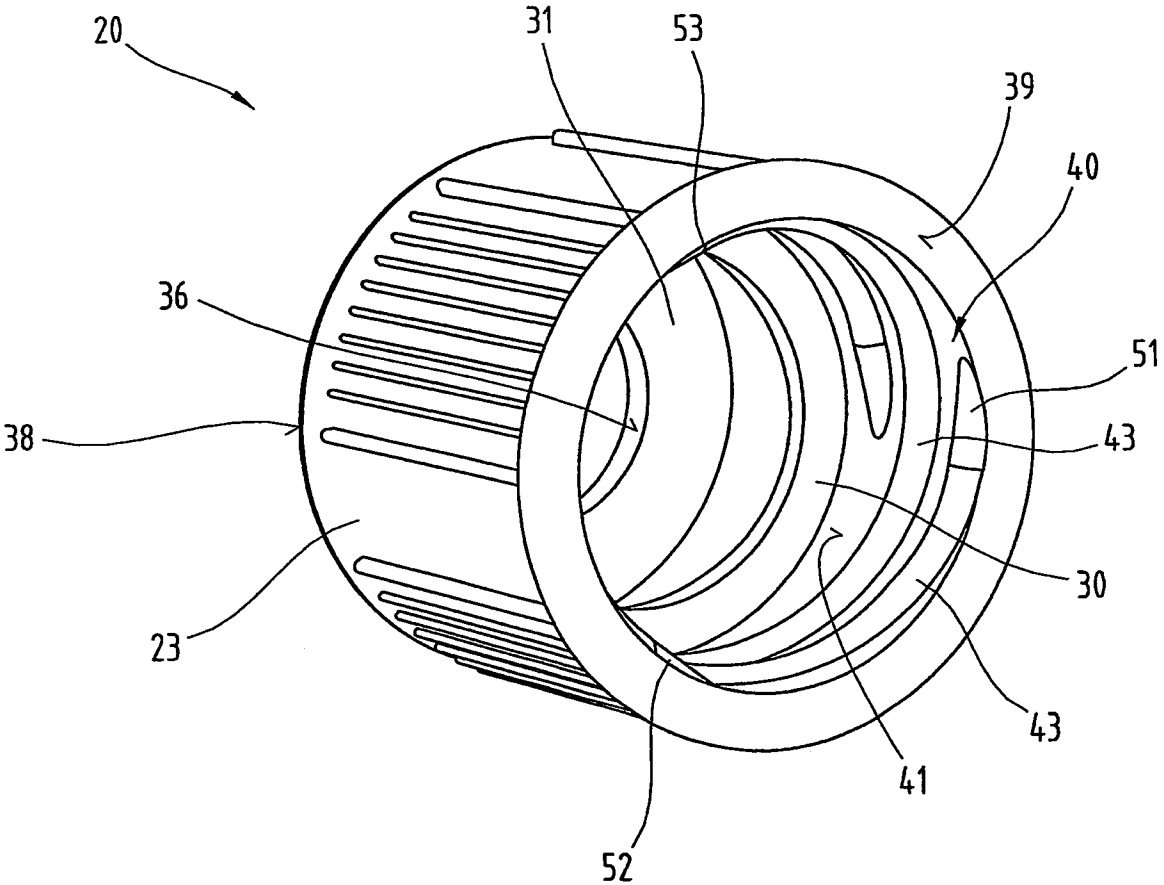
FIG. 5 is a schematic diagram showing the cap illustrated in FIGS. 3 and 4.

FIGS. 3 to 5 illustrate different views of the cap 20 used to form the container system 1, the same parts being denoted by the same reference numbers as those used for FIGS. 1 and 2 above.

In the embodiment illustrated as an example here, the thread arrangement 40 in the region of the cap 20 is a multiple thread system. Preferably, three threads 42 are provided across the internal surface 41 and the thread beginnings 51 to 53 of the individual threads 43 are disposed offset from one another by 120.degree. in the circumferential direction.

A thread length of the thread arrangement 40 or the individual threads 43 forming it is the same as or smaller than an internal circumference of the cap casing 23 in the region of the thread arrangement 40, as viewed around the circumference in the plane 49 oriented perpendicular to the longitudinal axis 14. As a result of the three-part thread described above, it is of advantage if a thread 43 extends around approximately half of the internal circumference of the cap casing 23. As may also be seen from the drawings, in particular from FIGS. 3 and 4, the thread or threads 43 project out from the internal surface 41 of the cap casing 23 in the direction towards the longitudinal axis 14. In order to reduce friction between the threads 43 illustrated here in the region of the cap 20 and the threads 42 briefly described above with reference to FIGS. 1 and 2, it is of advantage if the thread arrangement 40, in particular the threads 42 and/or 43, are provided with a coating in at least certain regions, although this is not illustrated. This being the case, it may be that only portions of the individual threads 42 and/or 43 which co-operate with one another are provided with this coating, although this is not illustrated.

Irrespective of the above or in addition, it may be of advantage if at least one of the respective co-operating portions has a surface roughness in ranges of between 0.0125.mu.m and 0.05.mu.m in order to reduce friction between the threads 42, 43.

The individual thread beginnings 51 to 53 are therefore close to the open end region 39 facing and enclosing the housing container 5 and as a result of their pitch or pitch angle 50 described above extend close to the projection 30. The pitch angle 50 and the circumferential extension of the individual threads 43 for the cap 20 of the housing container 5 of in the embodiment illustrated as an example are intended for a nominal size of 13 mm, which is currently a generally standard nominal size for such container systems 1. It should also be pointed out at this stage that although the seal stopper 22, in particular the shoulder 32, is retained between the two projections 29 and 30 and optionally has the retaining ring 31 ring in between, other fixing options are not ruled out.

FIGS. 6 to 9 provide a more detailed illustration of the housing container 5 used to form the container system 1, the same parts being denoted by the same reference numbers and the same component names as those used for FIGS. 1 to 5 described above.

Firstly, it should be pointed out that the description with respect to the design of the threads 42 on a housing container 5, in particular a blood sample tube, relates to one with a nominal size of 13 mm in terms of diameter. Where there are variations, in particular as regards diameter, the values given here must be correlated to other nominal sizes.

As described above, this nominal size of the container system 1 has proved to be practical if the thread arrangement 40 is of the multiple thread type and in particular has three threads, as a result of which the cap 20 can be joined or coupled with the housing container 5 by applying an exclusive pressing force in the direction of the longitudinal axis 14 by means of an assembly or joining process as described above.

Figure 6:
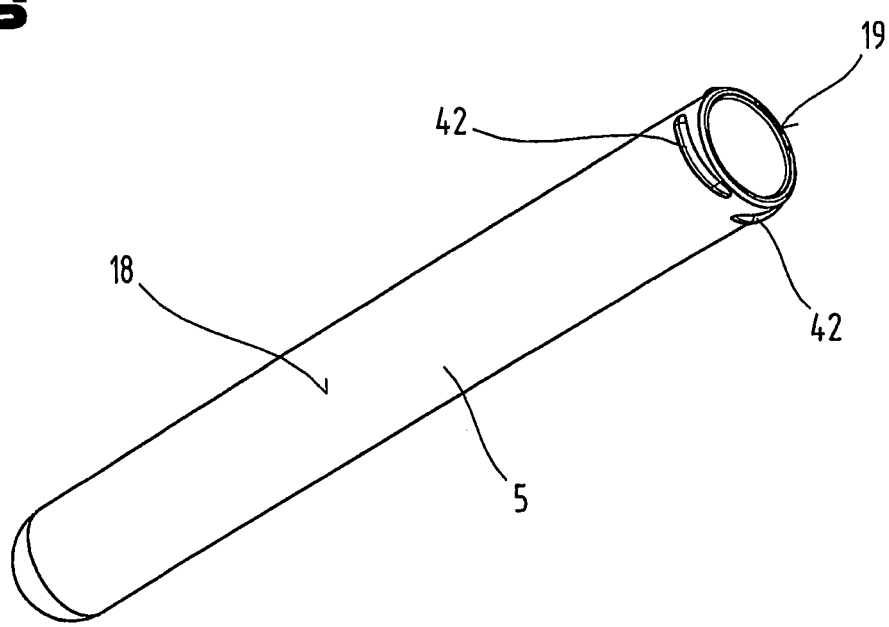
FIG. 6 is a simplified, schematic diagram illustrating a housing container proposed by the invention.
Figure 7:
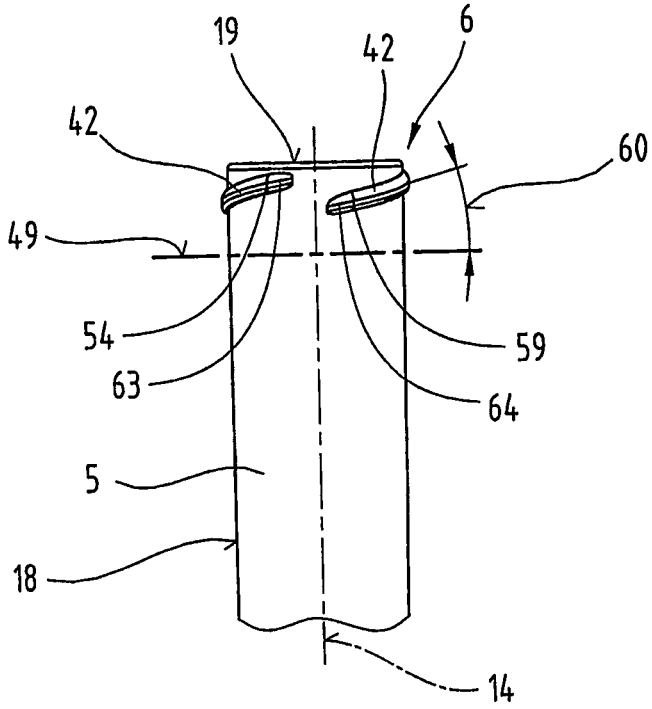
FIG. 7 is a simplified, schematic diagram illustrating a view in elevation of a part-region of the housing container shown in FIG. 6.
Figure 8:
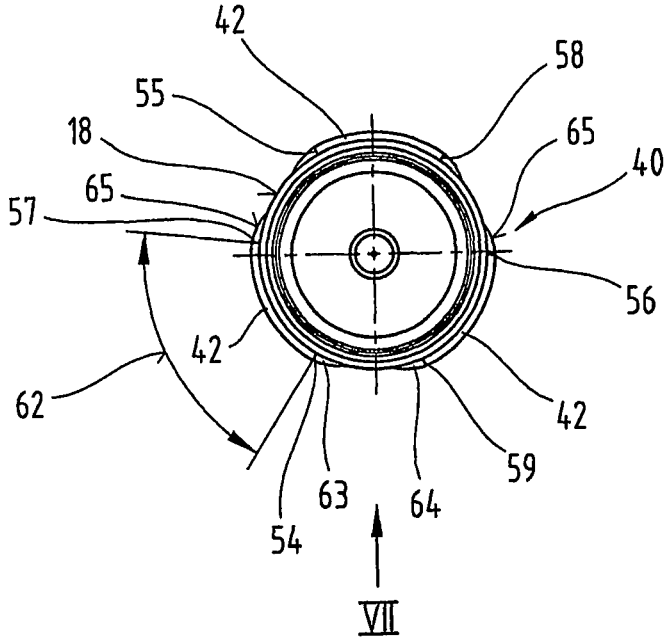
FIG. 8 is a plan view of the housing container illustrated in FIGS. 6 and 7 towards the closed end.

As may be seen by comparing FIGS. 6 and 8, the individual threads 42 making up the thread arrangement 40 are uniformly distributed across the external surface 18 of the housing container 5. Accordingly, the thread beginnings 54 to 56 and thread ends 57 to 59 delimit the individual threads 42 in their longitudinal extension around the circumference. As may be seen from a comparison of FIGS. 7 and 8, a pitch angle 60 of the thread or threads 42 making up the thread arrangement 40 by reference to a plane 49 oriented perpendicular to the longitudinal axis 14 is selected from a range with a lower limit of 2.degree., preferably 3.degree., in particular 5.degree., preferably of 8.degree., 10.degree., 13.degree., 15.degree., and with an upper limit of 30.degree., preferably 25.degree., in particular 20.degree., preferably of 16.degree., 13.degree. or 12.degree. Tests have shown that pitch angles 60 with a value of 9.degree., 10.degree. or 11.degree., 12.degree. are also practical. As explained above, the thread arrangement 40 is made up of more than one thread and the second part of the thread arrangement 40 also has three threads 42 distributed across the external surface 18 our outer surface.

As explained above, the two pitch angles 50, 60 are selected from the same ranges and, in order to achieve a perfect screwing-on operation, are selected so that they are identical. It has also been found that preferred pitch angles 50, 60 also have values with lower and upper limits of 3.degree. and 20.degree., 5.degree. and 16.degree., 8.degree. and 13.degree. as well as 10.degree. and 12.degree., the size of the selected pitch angle 50, 60 depending on the combination of materials used for the housing container 5, the cap 20 and the sealing device 21 as well as the coating used.

In this instance, the thread beginnings 54 to 56 of the individual threads 42 are disposed offset from one another by 120.degree. in the circumferential direction. The same also applies to the thread ends 57 to 59. Thread beginnings 54 to 56 and thread ends 57 to 59 disposed directly adjacent to one another are spaced apart from one another in the circumferential direction, as a result of which a sum of the thread lengths of the threads 40 forming the thread arrangement 40 in the plane 49 oriented perpendicular to the longitudinal axis 14 as viewed around the circumference is the same as or smaller than an external circumference of the housing container 5 in the region of the thread arrangement 40. Consequently, the respective threads 42 disposed directly adjacent to one another in the circumferential direction are spaced at a distance apart from one another in the circumferential direction.

In the embodiment illustrated as an example here, the threads 42 extend between their thread beginning 54 to 56 and their thread end 57 to 59 across an angle 61 as viewed around the circumference, which may be between 50.degree. and 80.degree. for example. This angle 61 is preferably selected so that it is approximately 65.degree. In this portion, the threads 42 assume their full thread height 62, as may best be seen from the diagram on a larger scale illustrated in FIG. 9.

Turning now to the plan view illustrated in FIG. 8, it may be seen that the thread 42 has a thread outlet 63 in the portion of its thread beginning 54 to 56 starting from the full thread height 62 and extending towards the external surface 18 of the housing container 5, which has a constantly decreasing height. It is also of advantage if the thread or threads 42 have another thread outlet 64 in the portion of their thread ends 57 to 59, starting from their full thread height 62, extending towards the external surface 18 of the housing container 5, which also has a constantly decreasing height. The thread outlet 63 and/or 64 is mostly formed by a transition radius 65. However, this thread outlet may be of any other shape in order to facilitate the joining operation. A different option may also be selected depending on the material.

Due to the fact that the individual threads 42 as viewed around the circumference do not overlap or extend beyond one another in their longitudinal extension and respectively adjacent thread beginnings 54 to 56 are disposed at a distance apart form the thread ends 57 to 59, it is possible to dispose the dividing plane of the mould used for the production process, in particular the injection mould process to make the housing container 5 in the region of the threads so that it extends along their highest point or highest line at and between the thread beginnings 54 to 56 and thread ends 57 to 59 disposed directly adjacent to one another and join the latter to one another by a connecting line in the region of the external surface 18 and form the mould dividing plane in this connecting line. This saves a significant proportion of the cost of making the moulds and also permits even faster cycle times. The idea of disposing the dividing plane of the mould in this manner in order to form external threads is known from patent specifications U.S. Pat. No. 3,926,401 A and US 2001/0055632 A1, for example. An embodiment for an internal thread is known from DE 30 47 856 C2, DE 296 18 639 U1, U.S. Pat. No. 2,133,019 A, U.S. Pat. No. 4,079,475 A, U.S. Pat. No. 4,188,178 A and U.S. Pat. No. 5,667,870 A.

Due to the fact that the threads 42 are distributed at a distance apart from one another as viewed across the circumference and therefore do not overlap or extend beyond one another, the housing container 5 can be taken out of the mould, not illustrated, through a mould opening in a purely axial direction, in other words in the direction of the longitudinal axis 14. This results in a simpler mould structure and thus reduces costs whilst simultaneously saving on space. The cycle time can also be reduced due to the simpler and shorter motion sequences needed to open and close the mould. A multiple arrangement of cavities for forming the housing container 5 in a single mould is possible and thus makes ejection performance faster and more practical.

Figure 9:
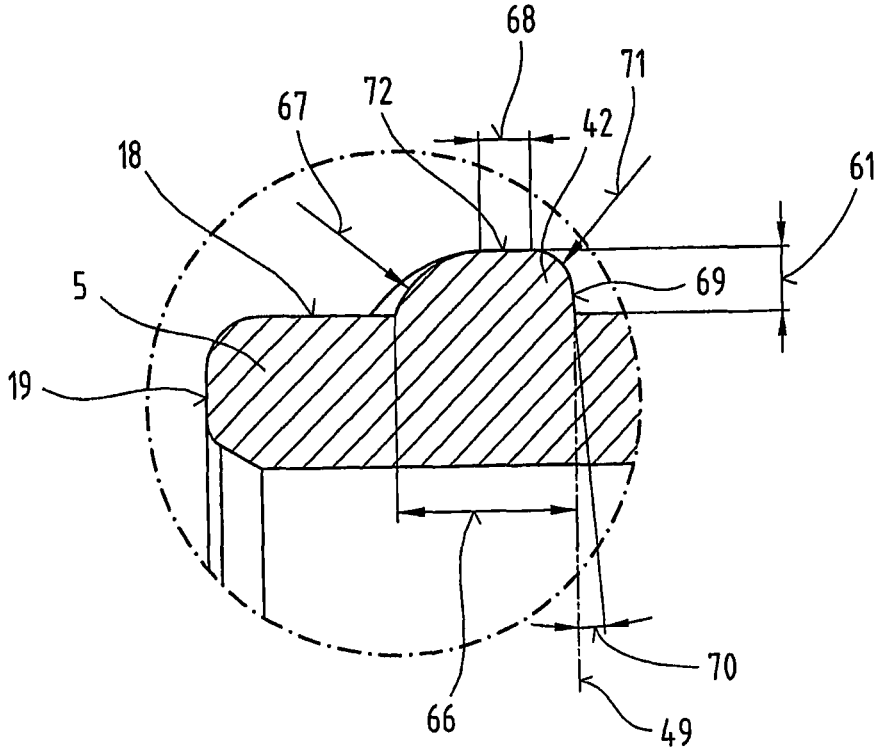
FIG. 9 is a simplified, schematic diagram showing a view in elevation, in section and on an enlarged scale, of a part-portion of the housing container illustrated in FIGS. 6 to 8 in the region of the thread.

As may be seen more clearly from FIG. 9, the thread or threads 42 have a different transition region form one another as viewed in cross-section, in other words in a plane extending parallel with and centrally through the longitudinal axis 14, starting from their full thread height 62 towards the external surface 18 of the housing container 5, as a result of which a thread cross-section of the thread 42 is non-symmetrical in this plane.

In the region of the external surface 18 in the direction more or less parallel with the longitudinal axis 14 and in the reference plane described above, the thread 42 has a base width 66, which may be 1.3 mm in the embodiment illustrated as an example here. Starting from this base width 66, the thread 42 has an exclusive radius 67 in the plane in question on the side facing the open end face 19 of the housing container 5, which starts at the external surface 18 and merges into the full thread height 62. In the portion of the full thread height 62, the thread 42 has an apex width 68, also extending parallel with the longitudinal axis 14, in the region of which the mould dividing plane may extend. This apex width 68 is approximately 0.6 mm in the case of the width 66 of 1.3 mm described above.

On the side remote from the open end face 19, the thread 42, has a transition surface 69 starting from the external surface 18 and extending to the full thread height 62 which is inclined at an angle in the direction towards the open end face 19, and this angle 70 in the embodiment described as an example here is 5.degree. with respect to the plane 49 oriented perpendicular to the longitudinal axis 14. Disposed between the apex width 68 extending parallel with the longitudinal axis 14 and the transition surface 69 is another radius 71, the size of which is 0.3 mm in the embodiment illustrated as an example.

As a result of the differently selected radii 67, 71, an asymmetrical thread 42 is obtained in which the first radius 67 is selected so that it is bigger than the other radius 71. For example, the first radius 67 in this embodiment is 0.7 mm and merges from the external surface 18 into the parallel apex width 68 of the thread 42. This apex width 68 of the thread 42 may also be termed an apex surface 72.

The apex surface 72 as well as the transition surface 69 may be described as an apex line or transition line or boundary line if the thread is viewed in cross-section.

As may also be seen from FIG. 7, the thread beginning 54 of the thread 42, in particular the thread outlet 63 itself, extends close to the open end face 19 of the housing container 5. This ensures that during the joining operation or assembly operation with the closure device 9, the mutually engaging threads 42, 43 forming the thread arrangement 40 are always engaged with one another until the fully closed position illustrated in FIG. 1 is reached, which means that the closure device 9 can always be screwed onto and unscrewed from the housing container 5 correctly.

Figure 10:
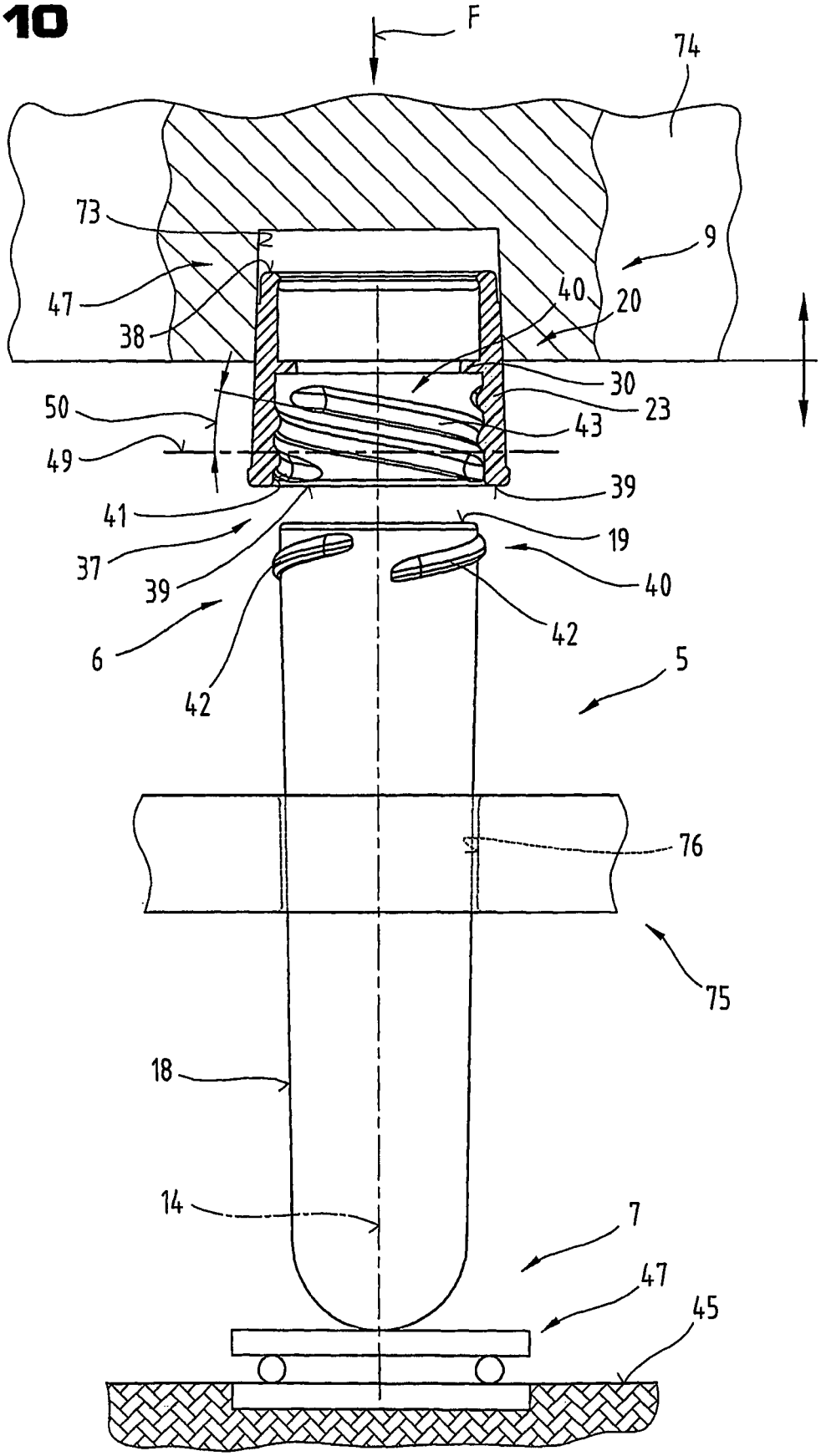
FIG. 10 is a simplified, schematic diagram showing a view in elevation and in partial section of the housing container and the cap with the seal stopper removed, in the region of another production or joining unit, in the position still separated from one another.

FIG. 10 illustrates another solution for joining or assembling the container system 1, similar to the design illustrated in FIG. 2, which may be construed as an independent solution in its own right. The components which are assembled to form the container system 1 are illustrated, namely the closure device 9 with in this instance the open end 6 of the housing container 5, still in a separated position, and again, in order to avoid unnecessary repetition, reference may be made to the more detailed description of the individual components given with reference to FIGS. 1 to 9 above. The same component names are used for the same parts as those used in connection with FIGS. 1 to 9 above.

In this diagram, the cap 20 is again shown in a simplified half-section and without the sealing device 21, with the cap 20 still in a position at a distance from the housing container 5 as viewed in the direction of the longitudinal axis 14. The thread arrangement 40 is also illustrated in a simplified form. As with FIG. 2, the reference numbers are shown in the diagram and to avoid unnecessary repetition, a more detailed description will not be given here because reference may be made to the explanations given above.

In the embodiment illustrated as an example here, unlike the assembly unit 46 illustrated in FIG. 2, the cap 20 is retained in the region of its external cap casing 23 in a holder 73 of a retaining plate 74 so that it can not rotate about the longitudinal axis 14 on the one hand and is stationary in the direction of the longitudinal axis 14 relative to the retaining plate 74 on the other hand. The pressing force (F) is again applied by displacement mechanisms, although these are not illustrated, such as positioning means for example. Again a multiple arrangement of the holders 73 in the retaining plate 74 is possible and even of advantage, as a result of which a plurality of caps 20 and already fully assembled closure devices 9 can be inserted in it and fixedly retained both about the longitudinal axis 14 and in the direction thereof.

Due to the conical and in this instance frustoconical design of the external surface of the cap 20 and cap casing 23 and the design of the holder 73 complementing it, a fixed bearing of the cap 20 can be obtained about the longitudinal axis 14 and in the direction of it depending on appropriately selected tolerances. However, a sufficiently fixed bearing can also be obtained with caps 20 of a virtually cylindrical design. Providing profiling on the external surface of the cap 20 is conducive to obtaining a fixed bearing for the assembly or joining operation.

Irrespective of the above, it would also be possible for the retaining plate 74 to be of an appropriately split design, in which case stops would be provided in the direction of the longitudinal axis 14 to enable a predefined correct longitudinal positioning of the cap 20 and closure device 9 in the retained or locked position in the retaining plate 74. Appropriate stops or shoulders may be used for this purpose, although these are not illustrated here. Using a retaining plate 74 of a split design in the region of the holders 73 enables the closure device 9 and cap 20 to be clamped and hence radially secured inside the retaining plate 74 by reference to the longitudinal axis 14.

By opting for this arrangement, a forced mutual orientation of the thread arrangement 40 of the housing container 5 and of the closure device 9 with respect to one another prior to the joining operation is no longer absolutely necessary, which also saves on the cost of the orientation process that would otherwise be needed. It is not just due to the shorter cycle times that costs can be saved.

In this embodiment illustrated as an example, the housing container 5 is supported by the thrust bearing 47 on the support surface 45 so that it can rotate about the longitudinal axis 14, and a positioning mechanism 75 is provided as a means of axially orienting and pre-positioning it by reference to the cap 20 and closure device 9. Disposed in this positioning mechanism 75 and illustrated in a simplified format is a guide orifice 76, which ensures that the housing container 5 is vertically oriented in readiness for the assembly or joining position. This guide orifice 76 has sufficient clearance from the external surface 18 of the housing container 5 to enable the rotating or pivoting movement generated about the longitudinal axis 14 by the stationary cap 20 to be effected. Different additional coatings may be applied to the inner surface of the guide orifice 76 facing the external surface 18, although these are not illustrated here. It is also possible to provide the guide orifice 76 in only certain regions around the external circumference of the housing container 5, in which case in the situation where there is a multiple arrangement of housing containers 5 and closure devices 9, for example, only individual vertical webs may be provided between the housing containers 5 disposed immediately adjacent to one another, which will provide a sufficiently reliable guide and positioning means and will ensure the ability to rotate or pivot relative to the closure device 9 to be joined.

In order to simplify automated assembly, however, the thrust bearing (s) 47 may be disposed on a displaceable assembly base and the assembly support with be filled with a corresponding number of housing containers 5 at a separate filling station, whilst at another station, the closure devices 9 to be assembled are also placed in an assembly support on which the retaining plate 74 may be pivotably or rotatably mounted so that they can also be inserted in the holder 73, after which the pre-filled assembly supports are moved to a separate assembly station at which the joining operation proposed by the invention takes place, namely applying a pure pressing force to screw them together. The advantage of this is that a plurality of housing containers 5 and/or closure devices 9 and cap 20 can be placed in retaining plates 74 and/or positioning mechanisms 75 on the assembly supports or workpiece holders separately from one another and the joining operation can take place in a separate assembly station.

As explained in detail with reference to the individual drawings, the operation of fitting the closure device 9 on the housing container 5 takes place purely on the basis of a conversion of the axial force acting in the direction of the longitudinal axis 14 into a relative rotating or pivoting movement between the components to be joined as far as the maximum screwing-in path which is restricted by a mechanical stop between housing container 5 and the cap 20 and/or the sealing device 21. In view of the fact that the length of the screwing-in path is mechanically fixed by the threads 42, 43 of the thread arrangement 40 co-operating in at least certain regions, the latter remain engaged during the entire screwing-on or screwing-in path, as a result of which, starting from the fully screwed-on position, the closure device 9 can be screwed off or released from the housing container 5 by a relative rotating or pivoting movement between the components to be separated. Since, in the fully screwed-on position, the relative position between the cap 20 and the housing container 5 is exactly predefined, the unscrewing path needed for releasing purposes is fixed by the circumferential length or extent of the angle of the mutually overlapping or mutually engaging threads 42, 43 and takes place by an opposite relative movement between the components.

This unscrewing process takes place in a controlled manner due to the threads 42, 43 cooperating in certain regions, and the sealing device 21 still retained in the cap 20 by means of the coupling mechanism 28 is also simultaneously removed or released from the housing container 5 as well. This simultaneously enables a secure removal or separation of the closure device 9 from the housing container 5. The co-operating threads 42, 43 prevent the sealing device 21 from being removed or released from the housing container 5 with a saccadic movement, thereby preventing any of the media 3, 4 or mixture 2 in the interior 10 from inadvertently escaping. This makes handling safer for the operating personnel, and potential contamination by escaping part-quantities and hence possible associated infections are ruled out. Due to the fact that the screwed-on end position can be predefined, however, uncapping of the closure device 9 from the housing container 5 can be handled by mechanical devices and systems because a pre-definable unscrewing path and hence a fixed relative rotation or pivot angle between the components to be separated is always clearly fixed.

Figure 11:
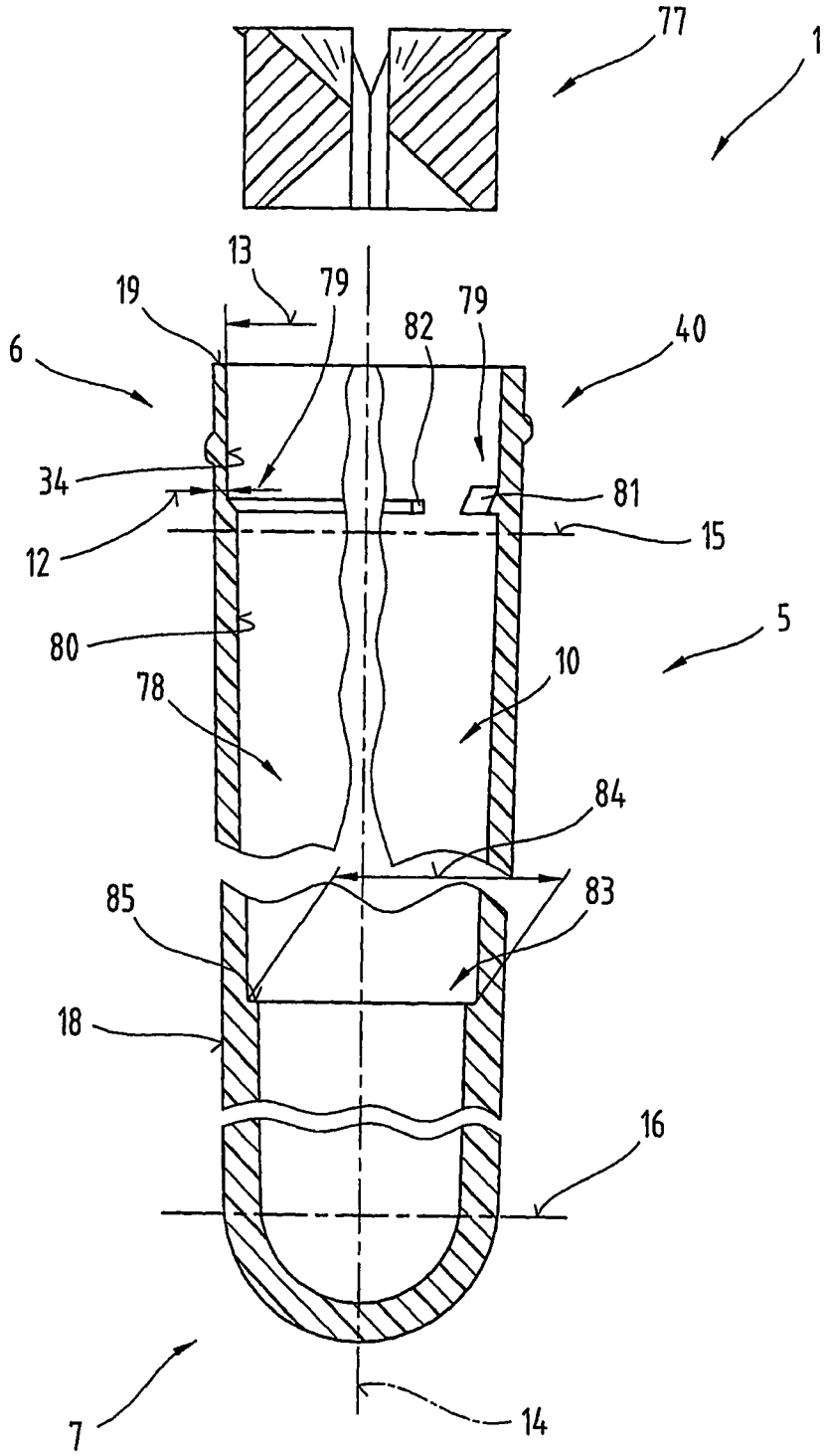
FIG. 11 is a simplified, schematic diagram showing a view in elevation and in section of several possible embodiments of the housing container, which may be construed as independent embodiments in their own right, with an additional separating device to be inserted in the interior.

FIG. 11 illustrates various different design possibilities of the housing container 5 in a single drawing, although these may also be combined with one another and with the possible embodiments described above in any way. For the sake of enhancing clarity, the closure device 9 has been left out of these drawings. Again, to avoid unnecessary repetition, reference may be made to the detailed description of FIGS. 1 to 10 above. The same parts are denoted by the same reference numbers and same references names as those used for the previous drawings.

In addition to the embodiments described above with reference to FIGS. 1 to 10, it is also possible to use the housing container 5 in conjunction with the closure device 9, not illustrated in this instance, for a container system 1. In this diagram, a separating device 77 is provided, which is inserted in the housing container 5 prior to closing the interior 10, although it is illustrated in a position disposed at a distance from the housing container 5 here. This separating device 77 may be of a design corresponding to the explanations given in patent specification WO 02/078848 A2 owned by the same applicant. For more details of the special design of the separating device, the housing container and the closure device, reference may be made to the above-mentioned patent specification WO 02/078848 A2, which is incorporated in this disclosure by way of reference. The selected concepts must be correlated to the concepts and diagrams given here.

The separating device 77 is inserted into the housing container 5 in the interior 10 or housing compartment 78 in the region of the open end face 19, where it is disposed in the so-called initial position, in which, once the housing container 5 has been closed by means of the closure device 9, which may also take place simultaneously or alternatively beforehand, the interior 10 is brought to a pressure below the ambient pressure, in particular evacuated. The container system 1 is filled in a known manner, for example by taking a blood sample, whereby the sealing device 21 is pierced by means of a cannula, not illustrated, as a result of which the mixture 2 comprising the media 3 and 4, in particular blood, illustrated in FIG. 1 flows through the flow passage or connecting orifice, through the separating device 77. The mixture can then be separated by means of a centrifugation process, as described in more detail in patent specification WO 02/078848 A2. When the separating device 77 is in the sealing position inside the housing container 5, it is in the so-called operating position, which is dependent on the total filled volume of the housing container and the proportion of the elements by volume of the mixture 2 to be separated. The operating position is usually selected so that it is more or less half-way along the longitudinal extension of the available housing compartment 78 of the housing container 5.

In the region of the initial position adjacent to the end 6 of the housing container 5 for the separating device 77 to be inserted in the interior 10 or housing compartment 78, various embodiments of the retaining mechanism 79 for it are illustrated. Accordingly, as illustrated in the right-hand part of the drawing, the retaining mechanism 79 is provided in the form of at least one shoulder 81 projecting from the circumference of an internal surface 80 in the direction towards the longitudinal axis 14 and/or by means of a web 82 projecting from at least certain regions of the circumference of the internal surface 80 in the direction towards the longitudinal axis 14. In this respect, both the shoulder 81 and/or the web 82 may extend around only certain regions of the circumference or optionally may also extend continuously around the entire circumference of the internal surface 80.

The top left-hand part of FIG. 11 illustrates another embodiment of the retaining mechanism 79, provided in the form of a reduction in the internal dimension 13 of the housing compartment 78, whereby, starting from the open end face 19, the sealing surface 34 for the sealing device 21, not illustrated, is disposed in particular the sealing surface 33 of the seal stopper 22. This reduction may be achieved due to the fact that, starting from the end 6 of the housing container 5, for example, the latter has the normal wall thickness 12 of the housing container towards the retaining mechanism 79 and with effect from the retaining mechanism 79, it has a bigger wall thickness in the direction of the other end, in which case the increase in the wall thickness 12 may be an offset region of the internal surface 80 in the direction towards the longitudinal axis 14. As an alternative to this, however, it would also be possible for the wall thickness 12 of the housing container 5 between the initial position and the other end 7 to be selected so that it is within the range of the rest of the wall thickness 12, in which case only the wall thickness between the initial position and what is here the open end 6 of the housing container 5 is of a slimmer design.

Depending on the embodiment of the retaining mechanism 79, the separating device 77 can be positioned in the direction of the longitudinal axis 14 until a pre-definable centrifugal force is reached at which the retaining forces are overcome and the separating device 77 moves relative to the housing container 5 until the operating position is reached.

In order to obtain a different secured position or relative fixed bearing of the separating device 77 in the region of the initial position, the retaining mechanism 79 between the housing container 5 and the separating device 77 may be provided in the form of a groove-shaped recess, although this is not illustrated here, which extends around the internal circumference of the internal surface 80 disposed set back into it.

To obtain a secured position or relative fixed bearing of the separating device 77 in the region of its operating position, a positioning mechanism 83 may be provided between the housing container 5 and the separating device 77, which is preferably provided in the form of a mechanically acting stop. This positioning mechanism 83 may be provided in the form of a reduction in the internal dimension 84 of the housing compartment 78 or interior 10, or optionally by forming an abutment surface 85 oriented more or less perpendicular to the longitudinal axis 14. Both the sealing device disposed in the first end region of the separating device 77, in particular the sealing lips, may be disposed on this abutment surface 85, and the other end region of it and its components may be supported. This results in a sealing contact, in particular a liquid-proof seal with respect to the media 2, 3 separated from one another on completion of the centrifugation process, even for longer periods of storage. This positioning mechanism 83 therefore serves as a mechanical stop for the separating device 77, terminating the relative displacement with respect to the housing container 5 in the direction of the longitudinal axis 14 towards the other end 7.

The reduction in the size of the interior 10, starting from the initial position as far as the operating position and between the first and other end 6, 7, is also provided in the housing container 5 illustrated here and forms a control cam for automatically closing the flow passage or passages in the region of the separating device 77. The tapered region of the housing container 5 described above, disposed in its interior 10 or housing compartment 78 between the two mutually spaced planes 15, 16, may be between 0.1.degree. and 3.0.degree., preferably between 0.6.degree. and 1.0.degree. In the case of a housing container with a nominal size of 13 mm (diameter) with a nominal length of 100 mm, the cone or cone angle subtended by the longitudinal axis 14 and the external surface 18 may be 0.34.degree. for example. This cone or cone angle is selected so that it is constant along the entire external longitudinal extension between the two ends 6, 7. The cone or cone angle of the internal surface 80, also by reference to the longitudinal axis 14, may be 0.46.degree. in the first part-region between the first end 6 and the positioning mechanism 83 for example, and also 0.46.degree. between the positioning mechanism 83 and the plane 16. However, it would also be possible for the portion of the sealing surface 34 to be of a cylindrical design to facilitate insertion of the seal stopper 22 of the sealing device 21—see FIG. 1.

FIGS. 12 to 16 illustrate another possible embodiment of the housing container 5, which may also be construed as an independent embodiment in its own right, for forming a container system 1 which can be closed by a closure device 9 for body fluids, tissue parts or tissue cultures, the same reference numbers and component names being used for the same parts as those described in connection with FIGS. 1 to 11 above. For the sake of avoiding unnecessary repetition, reference may be made to the detailed description given in connection with FIGS. 1 to 11 above. It naturally goes without saying that the embodiment of the housing container 5 described here may also be used in any combination with all the other embodiments contained in this description.

This housing container 5 is again used as a container system 1 for body fluids, tissue parts or tissue cultures, and in particular is used to contain a mixture 2 comprising two media 3, 4 of differing densities which have to be separated, as described above and illustrated in FIG. 1. In this instance, instead of the thread arrangement 40 described above, several, and in this particular instance three, projections 86 are distributed uniformly around the circumference, in the region of the open end face 19 in the region of the first end 6, projecting out from the external surface 18 to the direction remote from the longitudinal axis 14, of a type already known per se from the prior art. However, it would also be possible, instead of the projections 86, to provide the previously described threads 42 in conjunction with the threads 43 in the cap 20, as explained in detail with reference to FIGS. 1 to 10 above.

Starting from the open end face 19, the sealing surface 34 which sits in contact with the sealing surface 33 of the seal stopper 22 of the sealing device, not illustrated, extends in the region of the interior 10. Adjoining it is the other region of the interior 10 where the separating device 77 device illustrated in a simplified format in FIG. 11 is inserted, as may best be seen from FIG. 13. In order to make the filling process of the mixture through the flow passage or passages or connecting orifice in the separating device or by means of the flow passage or connecting orifice formed by it easier, at least one flow passage 87 is provided in the region of the initial position of the inserted or insertable separating device 77 in the region between the container wall 11 of the housing container 5 and the separating device 77. This flow passage 87 is used to transfer the quantity of air remaining in the interior 10 between the separating device 77 and the other end 7 past the separating device 77 into the interior 10 between the separating device 77 and the interior 10 closed off by the sealing device 21. The flow passages 87 may also be used as a means of transferring residual quantities of the mixture 2 which have not flowed through the flow passage or the connecting orifice in the region of the separating device 77, also into the interior 10 of the housing container 5 disposed between the separating device 77 and the other end 7.

As may be seen by comparing FIGS. 12 to 16, the flow passage 87 passage in this instance is provided by means of a cut-out 88 recessed into the internal surface 80 of the housing container wall 11. This cut-out 88 recessed into the internal surface 80 has a depth 89, starting from the internal surface 80 and extending in the radial direction towards the external surface 18 of between 0.1 mm and 1.0 mm, preferably between 0.2 mm and 0.5 mm. Several cutouts 88 are preferably distributed about the internal circumference, in which case it is of advantage to opt for a symmetrical distribution around the internal circumference by reference to the longitudinal axis 14. However, it would also be possible to provide the cut-out 88 extending round the den internal circumference, in which case it will be provided in the form of a groove-shaped recess or hollow cylinder.

The cut-out 88 has a base surface 90 disposed coaxially with the sealing surface 34, which therefore delimits the cut-out 88 in terms of its depth. Disposed between the base surface 90 and at least one of the boundary surfaces 91, 92 spaced apart from one another in the direction of the longitudinal axis 14 is a first transition surface 93. Another transition surface 94 may also be disposed on one of the boundary surfaces 91, 92 of the cut-out 88 spaced apart from one another in the direction of the longitudinal axis 14 and the internal surface 80. These two transition surfaces 93, 94 may be selected so that they already form the mutually spaced boundary surfaces 91, 92. These boundary surfaces 91, 92 are spaced at a distance apart from one another across a longitudinal extension 95 as viewed in the direction of the longitudinal axis 14. This being the case, the longitudinal extension 95 terminates before the sealing surface 34 which may face the sealing surface 33 of the seal stopper 22. In the direction remote therefrom, the longitudinal extension 95 of the cut-out 88 may extend as far as its maximum before the separating device 77 reaches the operating or separating position. By preference, however, it is selected so that it is shorter so that the flow passage 87 in the region of the internal surface 80 and the separating device 77 is established during the filling operation only and the separating device 77 only has to effect a short displacement in the direction towards its operating position before an element of the mixture is able to flow through the flow passage or connecting orifice in the region of the separating device 77. Otherwise, the sealing lips of the separating device 77 preferably sit in a sealing contact with the internal surface 80 of the housing container 5 to produce a perfect separation result.

In one possible embodiment, five cut-outs 88 are distributed in the housing container 5 around the internal circumference, which have a depth of 0.4 mm and a size of 1.9 mm in terms of their extension as viewed in the circumferential direction. In the direction of the longitudinal axis 14, these cut-outs have a longitudinal extension 95 of 3 mm. When selecting the depth 89 of the cut-out 88, the essential factor is that, in the region of the container wall 11, the thickness is still enough to guarantee that the container system 1 can still be stored in the unused state (with the vacuum maintained). In this respect, depending on the manufacturer, a period of 18 months is guaranteed, for example, within which the pre-set negative pressure will be maintained in the interior 10. With this design, allowance must be made for the permeability of the material to oxygen and water vapour, especially in this region.

Figure 12:
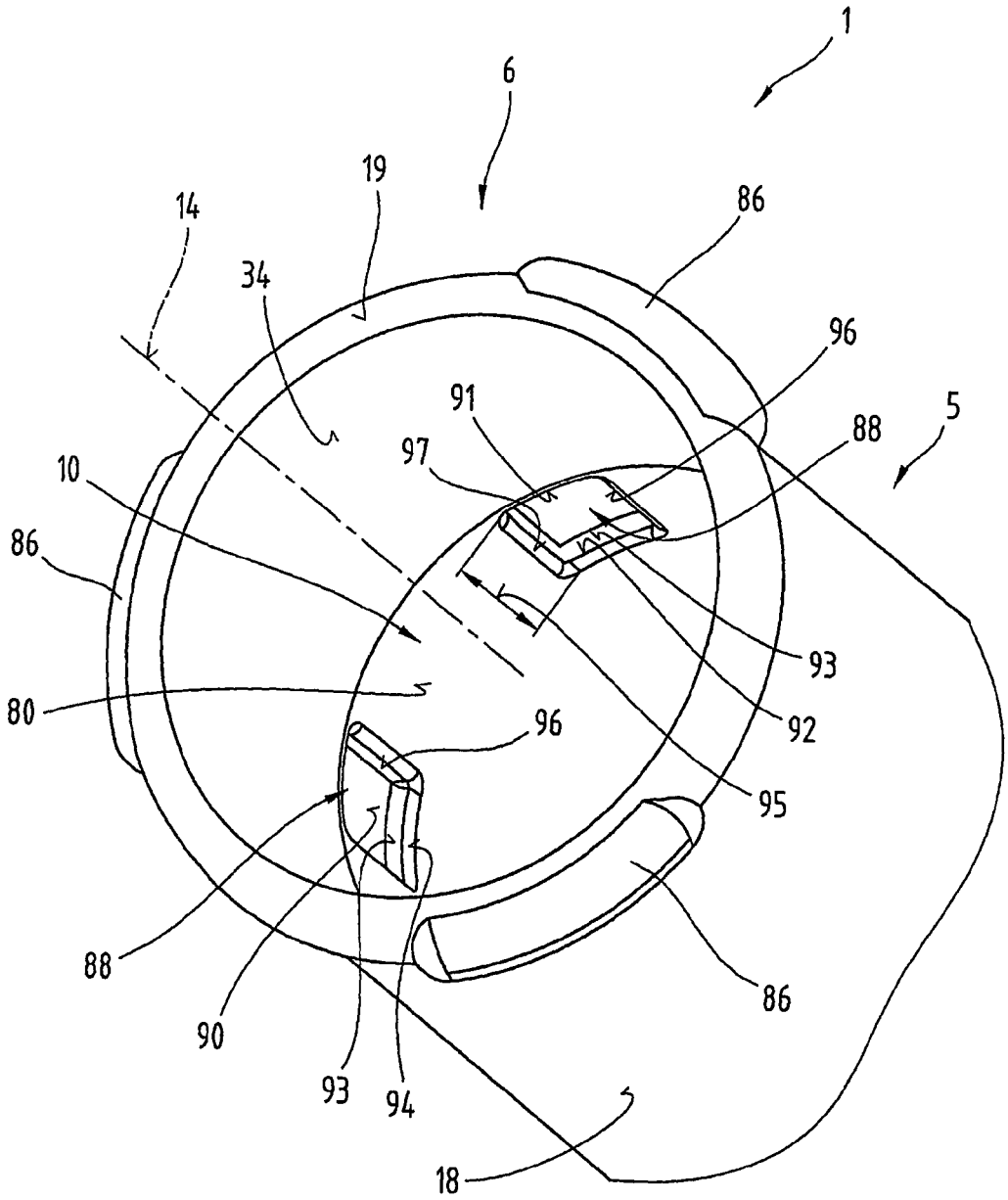
FIG. 12 is a simplified, schematic diagram showing a part-region of another possible embodiment of the housing container.
Figure 13:
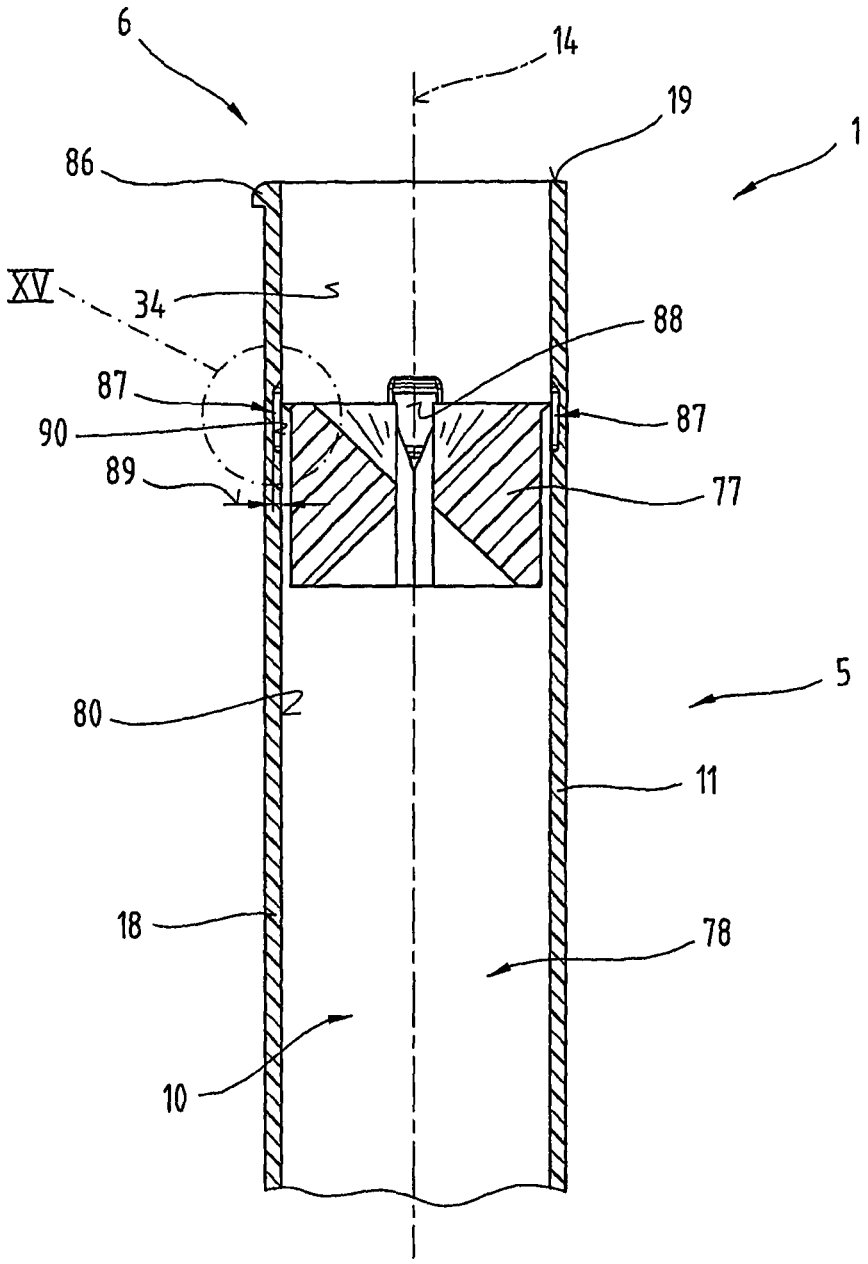
FIG. 13 is a simplified, schematic diagram showing a view in elevation and in section of the housing container illustrated in FIG. 12 with the separating device inserted in it.
Figure 14:
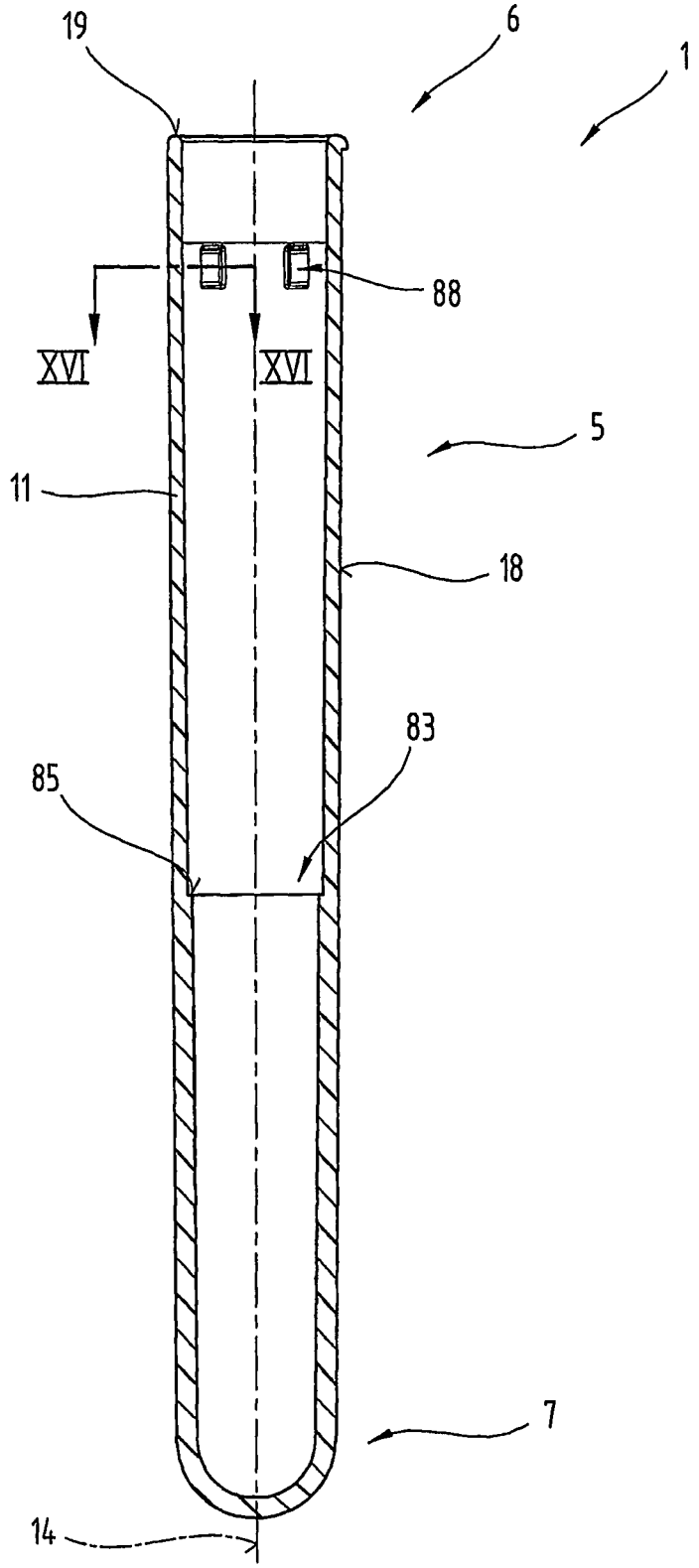
FIG. 14 is a simplified, schematic diagram showing a view in elevation and in section of the housing container illustrated in FIGS. 12 and 13 with an additional positioning mechanism for the separating device.
Figure 15:
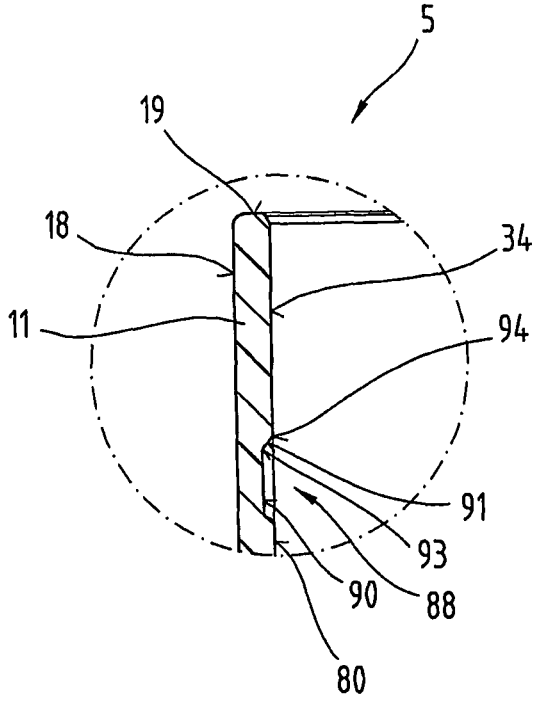
FIG. 15 is a simplified, schematic diagram on an enlarged scale showing a view in elevation and in section of a part-region of the housing container illustrated in FIG. 13 but without the separating device.
Figure 16:
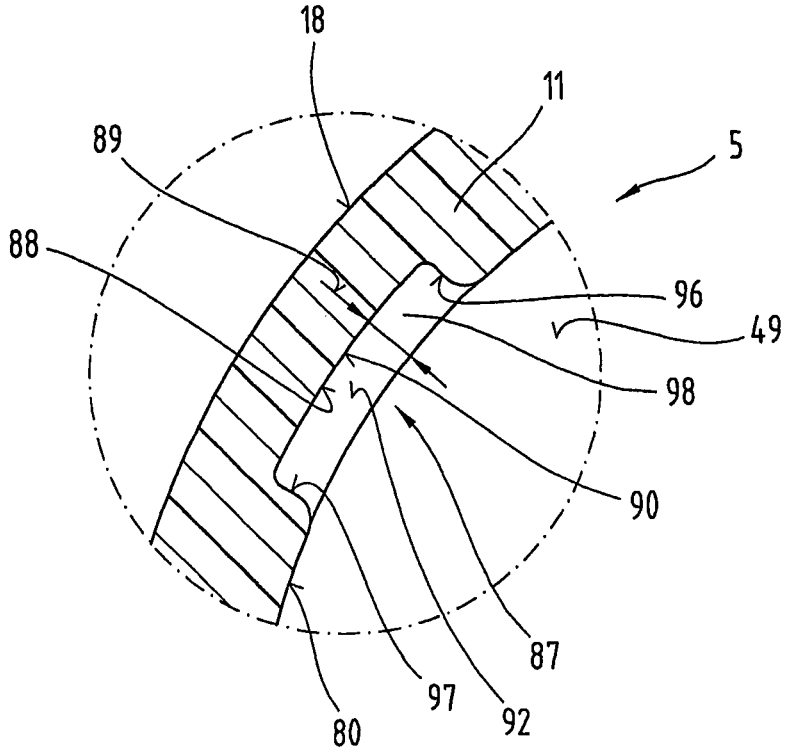
FIG. 16 is a simplified, schematic diagram showing a plan view in section along line XVI-XVI indicated in FIG. 14 of another part-region of the housing container in the region of the cut-out.

As may best be seen from FIGS. 12 and 16, boundary surfaces 96, 97 oriented in the direction parallel with the longitudinal axis 14 delimit the cut-out 88 as viewed in the circumferential direction. A flow cross-section 90 is bounded or fixed in conjunction with the two boundary surfaces 96, 97 and the depth 89 of the cut-out 88, which is dimensioned so that both part-quantities of the mixture 2 and residual quantities of air are able to flow simultaneously but in opposite directions without this flow passage 87 or the flow passages 87 becoming blocked. This being the case, the minimum flow cross-section 98 of the at least one flow passage 87 in the plane 49 perpendicular to the longitudinal axis 14 is at least 0.4 mm.sup.2. This size is the minimum dimension of this cross-sectional surface which is needed if the container system 1 is used as a blood sample tube, in order to permit a correct flow of a part of the mixture or medium with which it will be filled and force residual quantities of air in the direction opposite the flow direction.

In order to avoid or completely prevent elements of the mixture 2 from sticking or being deposited in the region of the cut-out 88, in particular on the boundary surfaces 91, 92 and/or 96 respectively 97, it is of advantage if at least one of these boundary surfaces 91, 92, 96, 97 or transition surfaces 93, 94 has a concave curvature. However, it would also be possible for one of these boundary surfaces 91, 92, 96, 97 and/or transition surfaces 93, 94 to be of a flat design. In order to remove the housing container 5 from the mould, in particular its core for forming the interior 10, it is of advantage if the boundary surface 91 or the transition surfaces 93, 94 lying closer to the open end face 19 form a relatively flat transition to the sealing surface 34 or internal surface 80, as may best be seen from FIG. 15. Accordingly, the boundary surface 91 is flat and the transition surface 94 disposed between it and the sealing surface 34 or internal surface 80 is convex, and is so in particular by means of a radius, and the transition surface 93 disposed between the base surface 90 and the boundary surface 91 is concave, preferably also by means of a radius.

In order to avoid or totally prevent elements of the mixture 2 from adhering in the region of the internal surface 80, in particular the flow passage 87 or cut-out 88, it is of advantage if this surface has a surface structure which makes adhesion more difficult or prevents it. In particular, a surface structure based on the "lotus blossom effect" may be used. This prevents residues of the mixture 2 from being deposited or sticking in precisely this region, which is very critical. However, this repellent surface structure may also be provided on the sealing device 21, the sealing surfaces 33, 34, the cap 20 and the separating device 77, in which case it need be provided in certain regions only.

Figure 17:
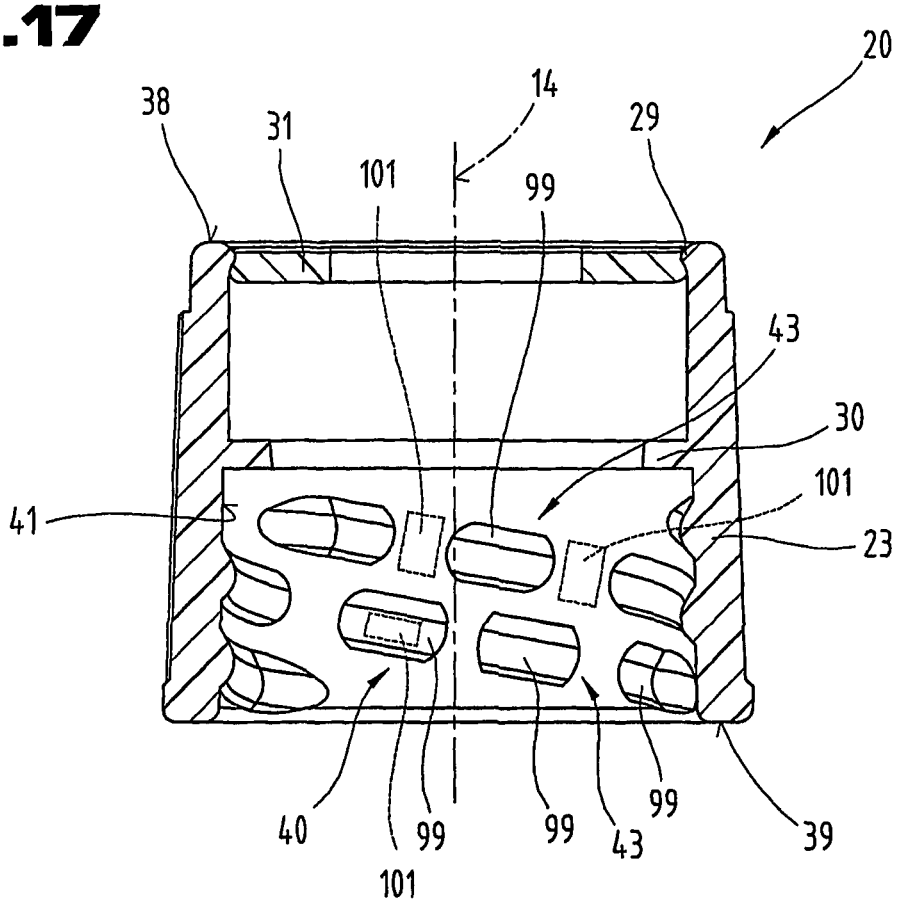
FIG. 17 is a simplified, schematic diagram showing a view in elevation and in section of another cap proposed by the invention with threads provided in the form of segments.
Figure 18:
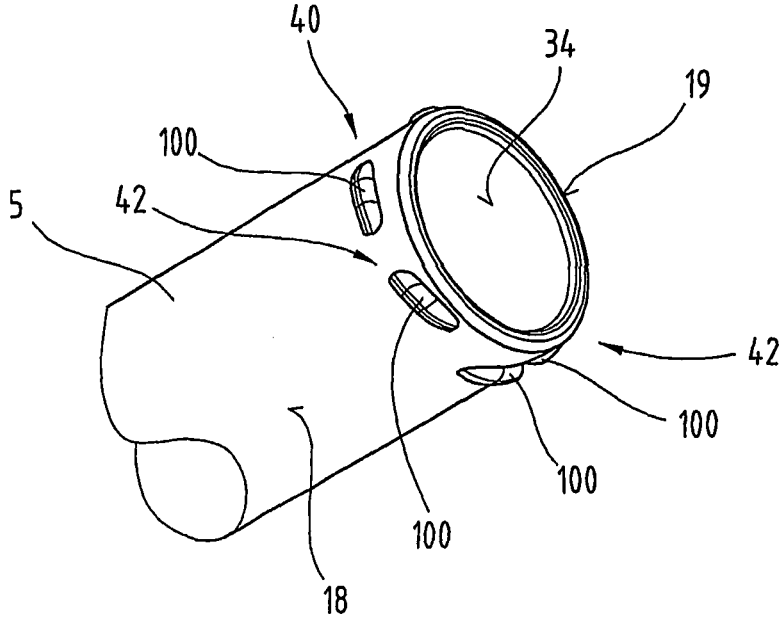
FIG. 18 is a simplified, schematic diagram of another housing container proposed by the invention with threads in the form of segments.

FIGS. 17 and 18 respectively illustrate different embodiments of the cap 20 and the housing container in a simplified format, which may also be construed as independent embodiments in their own right, and again, for the sake of avoiding unnecessary repetition, reference may be made to the detailed description of FIGS. 1 to 16 above. The same reference numbers and component names are used for the same parts as those illustrated in FIGS. 1 to 16 above.

FIG. 17 illustrates the cap 20 with its cap casing 23, parts of the thread arrangement 40 being disposed on the internal surface 41 facing the longitudinal axis 14 in the region between the end region 30 directed towards the housing container 5 and the projection 30. The thread or threads 43 in this instance are provided in the form of several first thread segments 99, which as viewed in their longitudinal extension, are disposed one after the other and spaced apart from one another in the circumferential direction. The shape of the thread segments selected here is only one of a plurality of possible designs and they may have various different geometric shapes. These thread segments 99 also project form the internal surface 41 of the cap casing 23 in the direction towards the longitudinal axis 14.

The thread 42 on the housing container 5 illustrated in FIG. 18 is likewise provided in the form of several other thread segments 100, which, as viewed in its longitudinal extension, are disposed one after the other and spaced at a distance apart from one another in the circumferential direction. These thread segments 100 may also be of different geometric shapes and project out from the external surface 18 of the housing container 5 in the direction remote from the longitudinal axis.

As indicated by broken lines in the region of the thread 43 in FIG. 17, the coating described above or a lubricant or lubricant additive may be provided in at least one recess 101 in the region of the thread 43. The recesses 101, which are only schematically indicated, may be disposed between the individual thread segments 99 in the cap casing 23 and/or alternatively directly in the region of the thread 43. For example, several recesses 101 may be distributed around the circumference in the cap casing 23 and threads 43, which are used to accommodate the coating and/or the lubricant or lubricant additive.

Figure 19:
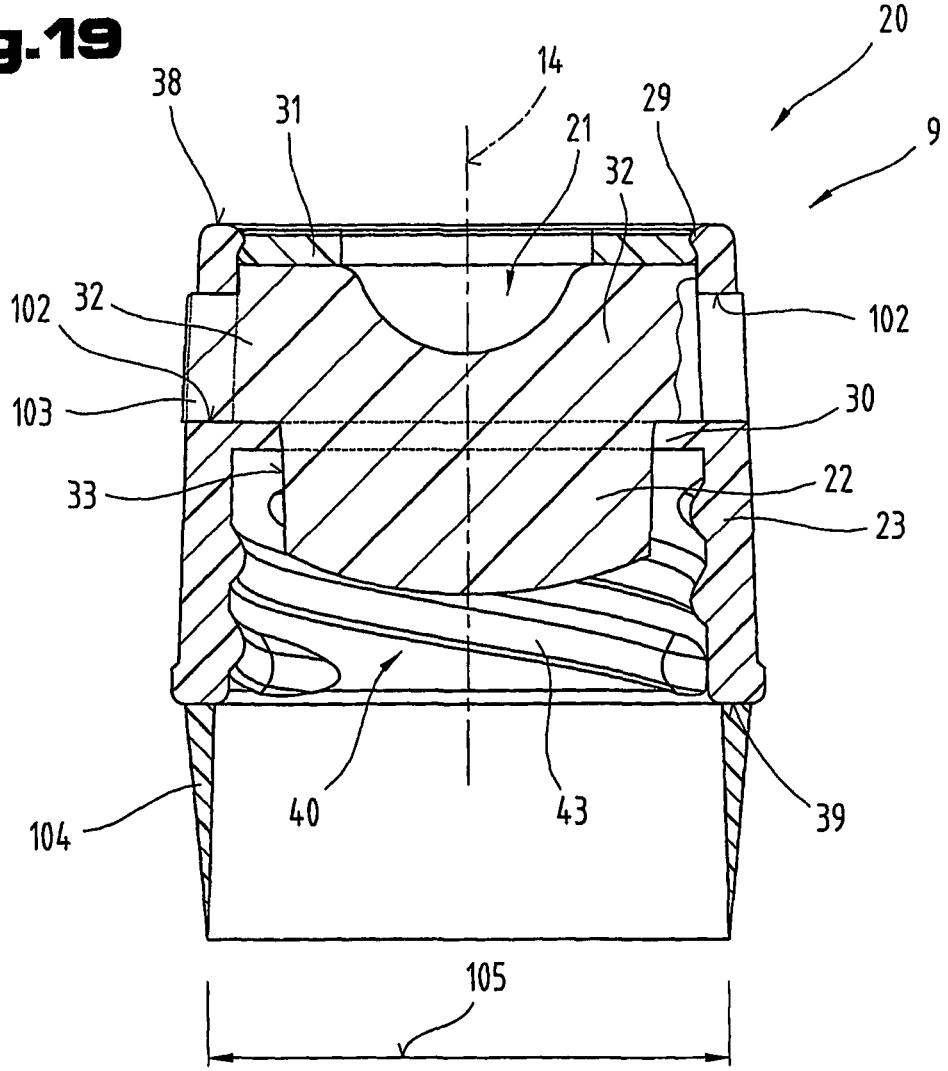
FIG. 19 is a diagram on an enlarged scale showing a view in elevation and in section of another cap proposed by the invention with a sealing device retained in it and a skirt-shaped projection.

FIG. 19 illustrates another possible design of the cap 20 in conjunction with the sealing device 21 inserted in it, which may also be regarded as an independent embodiment in its own right, and for the sake of avoiding unnecessary repetition, reference may be made to the more detailed description of FIGS. 1 to 18 above. The same reference numbers and component names are used to denote the same parts as those illustrated in FIGS. 1 to 18 above.

As described above, the groove-shaped region which accommodates the shoulder 32 of the sealing device 21 is bounded by the two projections 29, 30 spaced apart from one another in the direction of the longitudinal axis 14 and the retaining ring 31 which may optionally be inserted between them on the internal face of the cap casing 23. In the embodiment illustrated as an example here, at least one passage 102 may be provided in this portion of the groove-shaped accommodating region in the cap casing 23, which may be an orifice or hole or merely a cut-out in the cap casing 23.

When the sealing device 21 is in the assembled or inserted state, a projection 103 extending out from the shoulder 32 projects into this passage 102, which, in addition to the retaining system or coupling of the sealing device 21 in the direction of the longitudinal axis 14 forms another anti-rotation lock or other coupling of the sealing device 21 with respect to the cap 20 about the longitudinal axis 14. This passage 102 may be of different cross-sectional shapes, for example round, polygonal, oval, etc., and the passage preferably forms a window-type orifice in the cap casing 23. If several such passages 102 are provided around the circumference of the cap casing 23, it is of advantage if they are uniformly distributed around the circumference. Accordingly, the individual projections 103 projecting into the passages 102 may also project from the external surface of the cap casing 23 and simultaneously serve as a means of preventing the entire container system from rolling or turning on a flat or sloping surface. If the projections 103 extend by a certain degree out from the external surface of the cap casing 23, they may also simultaneously be used as a handle or gripping element for unscrewing the entire closure device 9 from the housing container 5, thereby improving handling and making it safer.

Another embodiment of the cap 20, which may also be construed as an independent embodiment in its own right, is illustrated on a simplified basis in FIG. 19, and in this case, a continuously extending protective element 104 is provided in the end region 39 of the cap 20 which faces and engages round the housing container 5 and projects in a skirt-design around the end region 39. This skirt-shaped protective element 104 may extend around only certain regions of the circumference of the cap casing 23, but preferably extends continuously around it. The protective element 104 may be provided as a separate component on the cap casing 23 or the protective element 104 may be designed as an integral part of the cap casing 23. As illustrated in a very simplified form, the protective element 104 has a constantly decreasing cross-section, the farther away it is from the end region 39.

An internal diameter 105 of the protective element 104 may correspond to approximately the external diameter or external dimension of the housing container 5, optionally plus the amount of the thread 42 extending beyond the external surface 18 of the housing container 5. The purpose of this protective element 104 is to provide a user of the container system 1 with additional protection against leakage or spraying, so that when the closure device 9 is being removed, there is no undesirable contact, which might otherwise occur due to the contents spraying out of the housing container 5. This reduces or totally prevents the possibility of a user being contaminated or infected.

Figure 20:
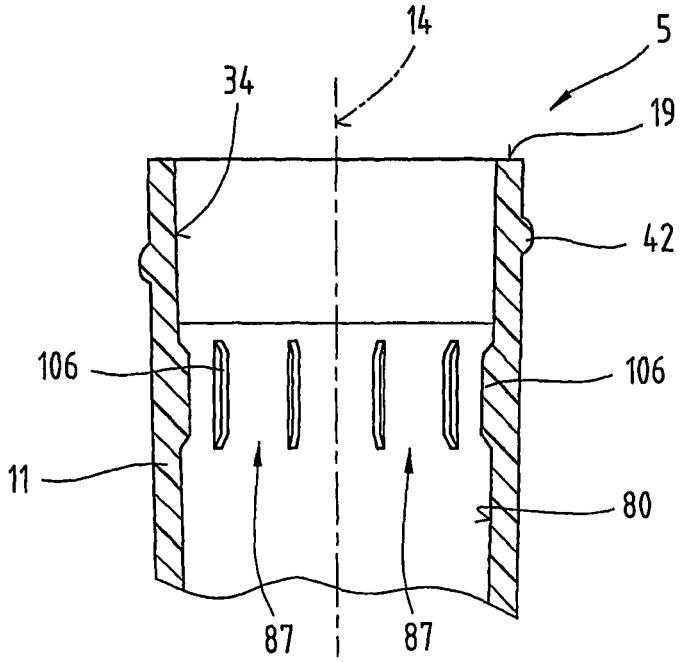
FIG. 20 is a simplified, schematic diagram showing a view in elevation and in section of another part-region of a different embodiment of the housing container designed to form the flow passage.

FIG. 20 illustrates another possible embodiment of a housing container 5, which may also be construed as an independent embodiment in its own right, and in order to avoid unnecessary repetition, reference may be made to the more detailed description of FIGS. 1 to 19 above. The same reference numbers and component names are used for the same parts as those illustrated in FIGS. 1 to 19 above.

The housing container 5 illustrated here is again preferably designed for inserting a separating device 77, although this is not illustrated, and, instead of the cut-out 88 for establishing the flow passage 87 as illustrated in FIGS. 12 to 16 and described above, has, by contrast, at least one but preferably several ribs 106 projecting from the internal surface 80 of the housing container 5 in the direction towards the longitudinal axis 14. The ribs 106 are of a web-type design and are preferably oriented parallel with the longitudinal axis 14. Several ribs 106 are distributed around the circumference on the internal surface 80 of the housing container wall 11 and between them—in other words as viewed in the circumferential direction—form the flow passages 87. Although not illustrated here, the separating device 77 lies on the boundary surfaces of the ribs 106 closer to and hence directed towards the longitudinal axis 14, as a result of which the flow passage(s) 87 is or are delimited between the separating device 77, the ribs 106 spaced apart from one another in the circumferential direction and the internal surface 80 of the container wall 11. A minimum cross-section of this flow passage 87 may be at least 0.4 mm.sup.2 but may also be bigger.

Figure 21:
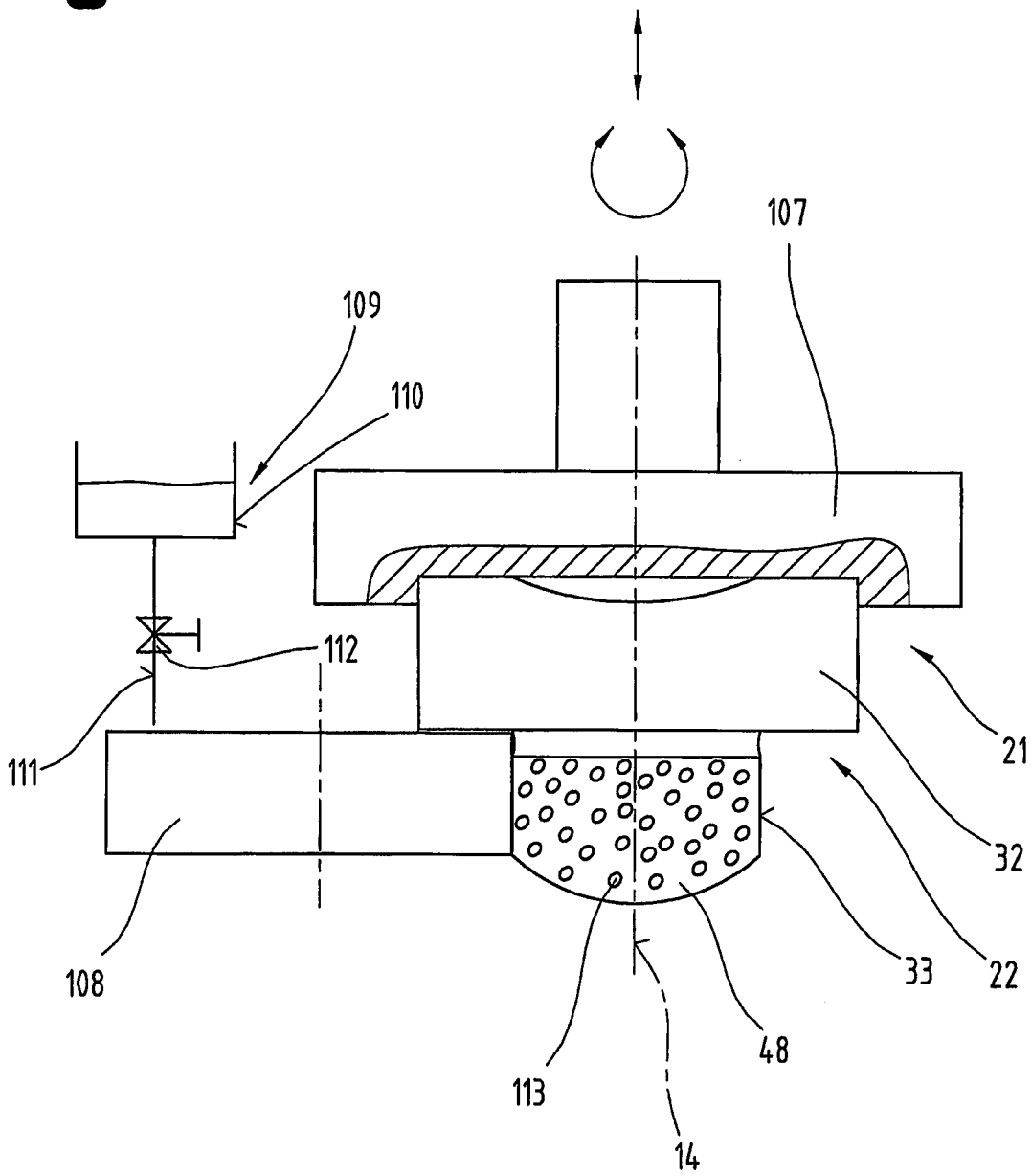
FIG. 21 is a highly simplified, schematic diagram showing a view in elevation and partial section of one possible way of applying a coating to the sealing device.
Figure 22:
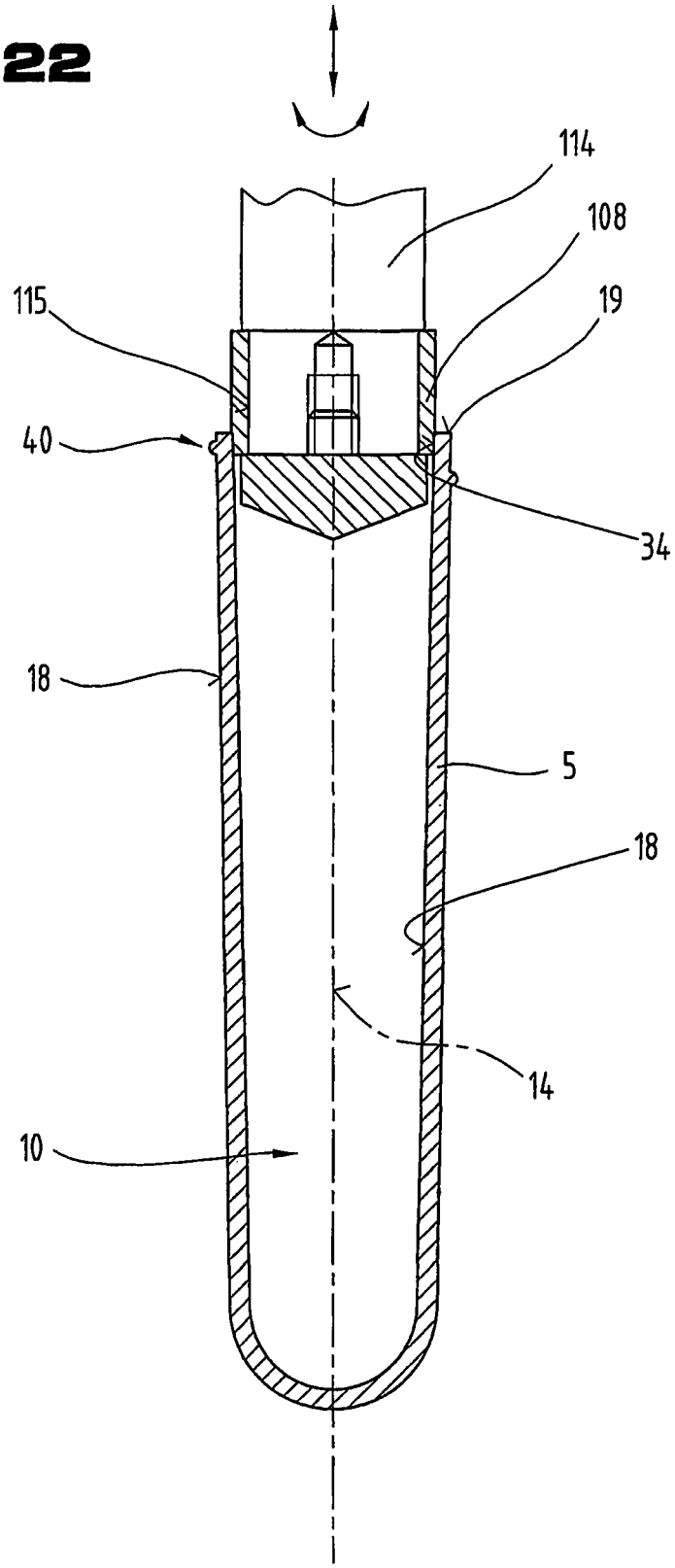
FIG. 22 is a highly simplified, schematic diagram showing a view in elevation and in section of another possible way of applying the coating to the housing container.

FIGS. 21 and 22 illustrate embodiments which may also be construed as independent embodiments in their own right, designed for applying the coating described above, and again, the same reference numbers and component names are used to denote parts that are the same as those illustrated in FIGS. 1 to 20 described above. For the sake of unnecessary repetition, reference may be made to the more detailed description of FIGS. 1 to 20 above.

FIG. 21 illustrates one possible option for applying the coating to the sealing surface 33 of the sealing device 21, in particular the stopper 48, which faces the internal surface 18 of the housing container 5 in the inserted state and thus seals off the interior 10 from the external ambient atmosphere. The shoulder 32 of the sealing device 21 may be retained in a holder 107, which is illustrated in a very simple form, and the sealing surface 33 to be coated is provided with a coating element 108 illustrated in a very simple form. The latter can be driven in rotation about a rotation axis as indicated and about its own axis automatically and/or alternatively may additionally be coupled with a drive. The holder 107 together with the sealing device 21 effects a rotating movement and, because the coating element 108 sits in contact with the surface to be coated—in this instance the sealing surface 33—the coating material is transferred from the coating element 108. For the sake of clarity, the drive has been left out of the drawing. However, another possibility would be for the coating element 108 to be driven and the sealing device 21 retained in the holder 107 could be driven with it as a result of the abutting contact. The rotating movement could also have another movement superimposed on it, as indicated by the double arrow, in the direction of the longitudinal axis 14 of the sealing device 21.

In order to supply the coating medium, the coating element 108 is provided with a supply device 109. If a liquid coating medium is used, such as silicone oils, wax, waxy polymers, fatty alcohols, fatty acid esters, fatty acid amides or similar, for example, it is stored in a container 110 and supplied via a supply line 111, in which a metering element 112 may also be disposed. The quantity supplied in this manner may be supplied in drops, depending on the number of units and the surface seal stopper 22 to be coated. The cycle times for the supply line may be based on a number of between 50 and 300 units, which means that once the number of coated units of seal stoppers 22 is reached, a pre-definable quantity of coating medium, e.g. one drop or more, is delivered again. The coating element 108 stores the coating medium supplied to it and transfers it to the surface or body in order to form the coating.

It may also be of advantage if the surface to be coated—in this instance the sealing surface 33—incorporates orifices 113, such as pores, for example, distributed across the sealing surface 33, so that additional coating medium can be introduced into them in order to form the coating. As a result, when the stopper 48 is initially inserted in the housing container 5 and removed for the first time, more coating medium can be supplied to make insertion easier in the event that some of the coating has already been scraped off the sealing surface 33.

It would also be possible for the sealing device 21 to be placed in a guide track, in which case it will preferably be straight, so that the shoulder 32 lies on the guide track, the stopper 48 extends through the guide track and brings the sealing surface 33 in contact with the coating element 108, thereby transferring the coating medium. This being the case, the coating element 108 may be provided in the form of a strip-shaped component, which lies on the sealing surface 33 against one face and causes a combined rotating and longitudinal movement of the sealing device 21 relative to the guide track due to a movement of the coating element 108 parallel with the guide track. The sealing device 21 on the one hand rotates about its longitudinal axis 14 and on the other hand is moved along the guide slit. This being the case, it is also preferably possible to dispose several sealing devices 21 at a distance one after the other in the guide slit, thereby enabling several sealing devices 21 to be coated simultaneously with one coating movement.

FIG. 22 illustrates one possible way of applying the coating to the internal surface 18 of the housing container 5 in the region of the open end face 19. The surface to be coated, in particular the sealing surface 34, may be the one which faces the sealing surface 33 of the stopper 48 in its inserted state.

If the housing container 4 is of a rounded design, the coating element 108 is disposed on an external face of a pin 114 and projects radially around the pin 114, its external dimension being selected so that it matches the internal dimension 13 of the housing container 5. The coating element 108 is fixedly retained in a groove-shaped recess 115 on the pin 114 and extends around the pin 114 in the radial direction. This enables an exclusive contact to be established between the surface 18 of the housing container 5 to be coated and the coating element 108 in a flush orientation. The coating element 108 in this instance is tubular. The supply system and the system for metering the quantity may be of the type described in connection with FIG. 21. It is also possible for a movement of the pin 114 in the direction of the longitudinal axis 14 to be combined with a movement about it, as indicated by the double arrows.

The coating may be applied to the external surface 18 of the housing container 5 in the region of the thread arrangement 40 in the same way as the coating is applied to the internal surface 18, in which case the coating element has an orifice adapted to the external dimension of the housing container 5.

With a timed cycle of 300 coatings, for example, a quantity of silicone oil can be applied to the internal surface 18 of the housing container 5 with every subsequent metering operation amounting to between 0.1 mg and 0.001 mg, preferably between 0.07 mg and 0.04 mg, in particular 0.05583 mg. With a timed cycle of 60 coatings, for example, a quantity of silicone oil can be applied to the external surface 18 in the region of the thread arrangement 40 with every subsequent metering operation amounting to between 0.6 mg and 0.1 mg, preferably between 0.4 mg and 0.2 mg, in particular 0.27917 mg. These weight-based figures relate to a housing container 5 with a nominal size of 13 mm and to only those surface regions to be provided with a coating. The coated surface area on the housing container 5 for an immersion depth of between 1 to 2 mm at the internal surface is ca. 75 mm.sup.2 and at the external surface is ca. 70 mm.sup.2. A surface area of ca. 146 mm.sup.2 can be coated on the stopper 48 of the seal stoppers 22.

Figure 23:
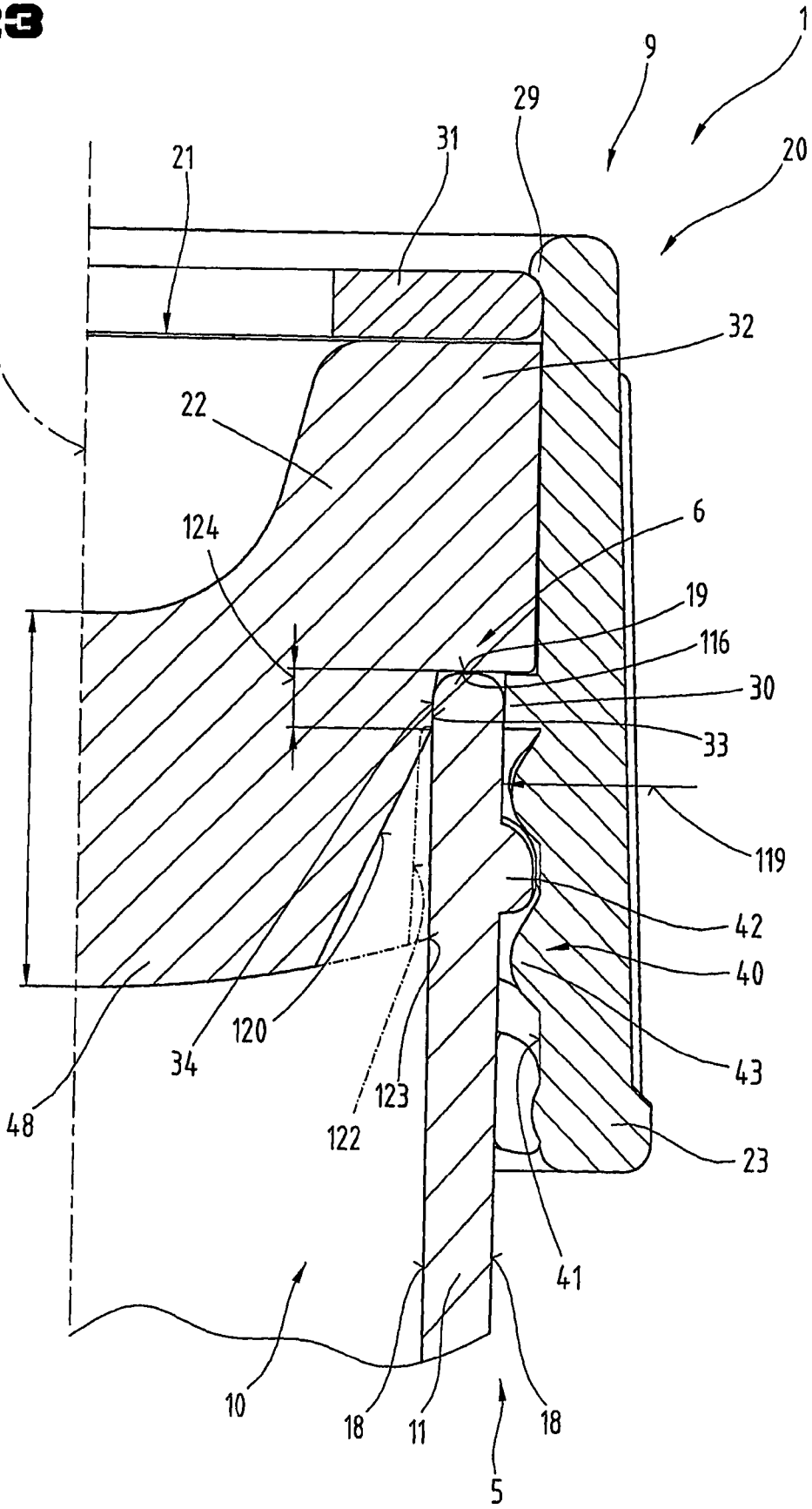
FIG. 23 is a highly simplified, schematic diagram showing a view in elevation and in section of a part-region of a different container system proposed by the invention with a cap in the position completely screwed onto the housing container.
Figure 24:
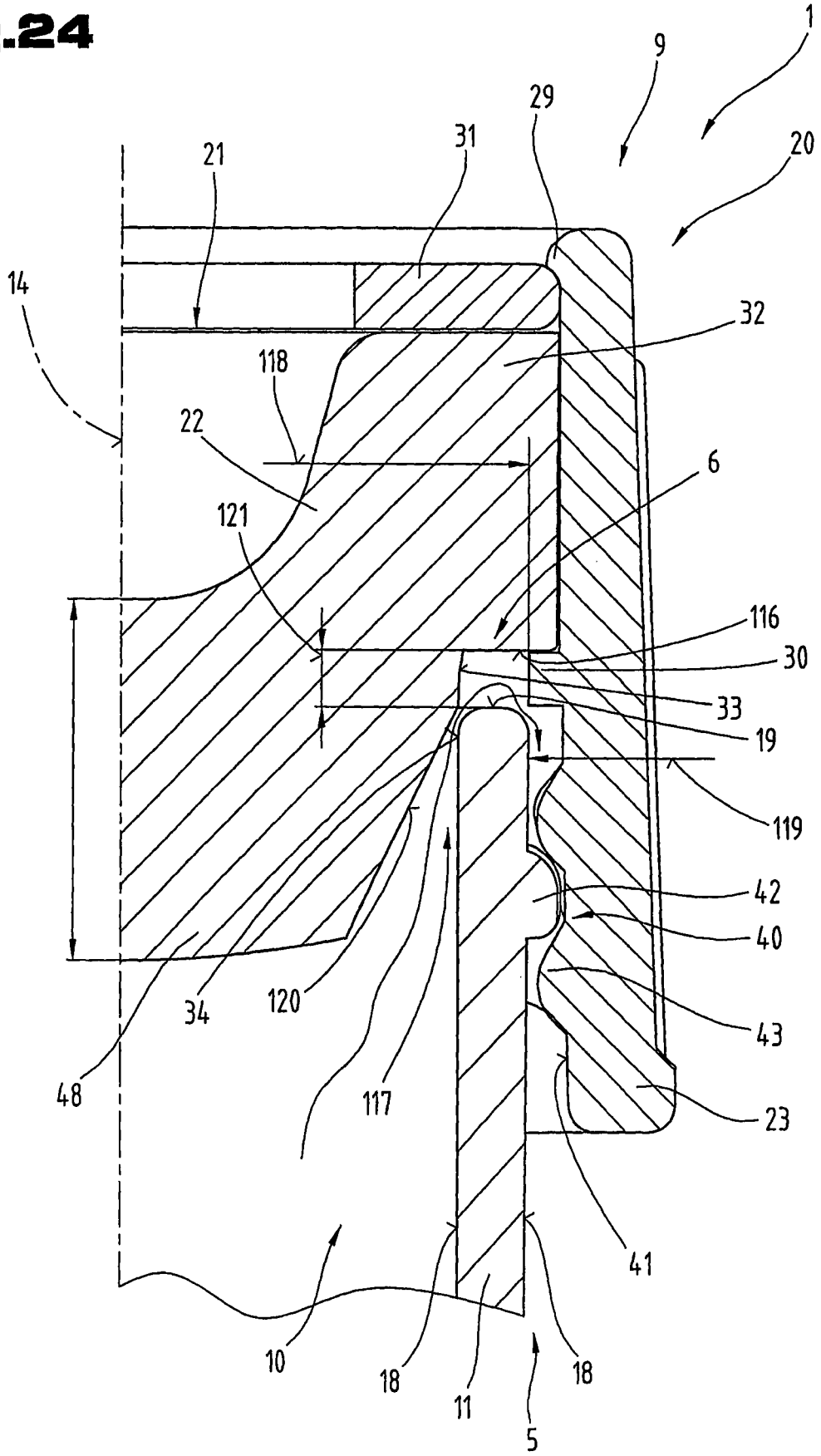
FIG. 24 shows the container system illustrated in FIG. 23 but with the cap in a partially screwed-off position and the threads still engaged.

FIGS. 23 and 24 illustrate another possible embodiment of the container system 1, which may also be construed as an independent embodiment in its own right, in particular the closure device 9 for the housing container 5, shown in a simplified schematic diagram on a larger scale, the same reference numbers and component names being used to denote the same parts as those illustrated in FIGS. 1 to 22 above. For the sake of avoiding unnecessary repetition, reference may be made to the more detailed description given above with reference to FIGS. 1 to 22.

In the embodiment illustrated as an example here, the shoulder 32 of the sealing device 21 in the region of the cap 20 is secured by means of the projection 30 extending out from the internal surface 41 of the cap casing 23 in the direction towards the longitudinal axis 14 on the one hand and the other projection 29 disposed at a distance apart from it on the other hand, and optionally with the retaining ring 31 disposed in between, as described in more detail above with reference to FIG. 1.

By contrast with the diagram given in FIG. 1, the projection 30 illustrated here is disposed laterally adjacent to the external surface 18 of the housing container 5 in the region of the open end face 19 and may also sit in abutment with it. The stopper 48 of the seal stopper 22 has in its middle region—in other words in the region of the longitudinal axis 14—a thickness or size in the direction thereof that is ca. 3.0 to 4.0 mm, this thickness being dependent on the material selected for the seal stopper 22, in particular the stopper 48. As explained above, it is made from a material which can be pierced and re-sealed again so that the orifice of the cannula or needle is closed after piercing and liquid or gaseous substances are reliably prevented from passing through for a pre-definable period.

The stopper 48 has the sealing surface 33 which faces or which can be placed facing the internal sealing surface 34 of the housing container 5, which in this embodiment is of a shorter design in the direction of the longitudinal axis 14 than the embodiments described above. Accordingly, the sealing surface 33 may be shorter in its longitudinal extension in the direction of the longitudinal axis 14 by half, for example. However, a dimension of between 1.0 mm and 2.5 mm, preferably 1.5 mm in this direction is possible.

By reducing the sealing surface 33 in the region of the stopper 48, another sealing surface 116 is provided on and in the region of the radially projecting shoulder 32 in the area directed towards end face 19, which co-operates with the open end face 19 of the housing container 5 when the seal stopper 22 is in the position fully inserted in the interior 10 of housing container 5. This enables the reduction in the sealing surface 33 in the region of the stopper 48 to be at least partially compensated. The advantage of this, when the seal stopper 22 is in the inserted state is that, in spite of a reduction in the sealing surface 33 facing the internal surface 18 or sealing surface 34 of the housing container 5, an additional sealing surface 116 is provided in the region of the open end face 19. Also as a result of the shortening of the sealing surface 33 on the stopper 48, the relative displacement path between the housing container 5 and the closure device 9 is reduced to the degree that, as may best be seen from FIG. 24, with the threads 42, 43 of the thread arrangement 40 still engaged, at least one passage 117 is formed or left free between the stopper 48, in particular the sealing surface 34, and the open end 6 of the housing container 5 in the region of the sealing surface 34 and the end face 19. Consequently, at least one passage 117 is formed between the sealing device 21 and the open end 6 of the housing container 5 when the threads 42, 43 of the thread arrangement 40 on housing container 5 and on the cap 20 are still engaged. Consequently a pressure compensation between the interior 10 of the housing container 5 and the external ambient atmosphere is still possible in the overlapping position between the cap 20 and the housing container 5, as schematically indicated by a wavy arrow in FIG. 24.

Due to the fact that the threads 42, 43 of the thread arrangement 40 are still engaged in this position, a controlled movement can be effected when extracting the stopper 48 from the housing container 5 in order to create or form the passage 117, and again, care must be taken to ensure that the entire seal stopper 22 is secured efficiently in the cap 20. If there were not a sufficient mutual hold, the seal stopper 22 would remain on or in the housing container 5 and only the cap 20 would pulled off; separately from the seal stopper 22. In the embodiment illustrated as an example here, the projection 30, which preferably extends continuously across the entire internal circumference of the cap casing 23, has an internal clearance width 118 more or less corresponding to an external dimension 119 of the housing container 5 in the region of the open end 6. The smaller the difference between the clearance width 118 and the external dimension 119, the bigger the gap is between the projection 30 and the external surface 18 of the housing container 5 when the closure device 9 is in the screwed-on position. The projection 30 may also be disposed in contact with the external surface 18 of the housing container 5, in which case the internal clearance width 118 of the projection 30 corresponds to the external dimension 119 of the housing container 5. If, on the other hand, the internal clearance width 118 of the projection 30 is slightly smaller than the external dimension 119 of the housing container 5, an easy press-fit connection is achieved between the cap 20 and the housing container 5. In order to form the passage or passages 117 in such situations, the projection 30 is interrupted in at least certain regions as viewed around the circumference or cut-outs are provided on the surface facing or lying against the housing container 5.

As may best be seen from FIG. 24, an oblique surface 120 tapering in the direction towards the longitudinal axis 14 is provided on the stopper 48 of the sealing device 21 between the sealing surface 33 which is or can be directed towards the housing container 5 and the other sealing surface oriented more or less perpendicular to the longitudinal axis 14 and facing the interior 10. This being the case, the oblique surface 120 may form part of a cone surface, for example. However, it would also be possible to use any other geometric shapes to obtain the oblique surface 120. As a result of this oblique surface 120, the sealing surface 33, which is preferably cylindrical by reference to the longitudinal axis 14, is reduced in terms of its dimensions or size and in this instance, for example, the sealing surface 33 on the stopper 48 may have a longitudinal extension or dimension 121 in the direction of the longitudinal axis 14 that is between 1.0 mm and 2.5 mm, preferably 1.5 mm. This length in the direction of the longitudinal axis 14 or the dimension 121 is selected so that when the seal stopper 22 is fully inserted, the mutually facing sealing surfaces 33, 34 and 116 and the open end face 19 are guaranteed to be sufficiently impermeable to gas and impermeable to liquid for a pre-definable period of storage and will sit continuously in contact with the circumference.

As indicated by dotted-dashed lines in the region of the oblique surface 120 in FIG. 23. instead of the latter, it would also be possible to provide the passage or passages 117 by means of at least one groove-shaped recess 122 in the region of the sealing surface 33 of the stopper 48. Several groove-shaped recesses 121 may also be distributed around the circumference of the stopper 48 or sealing surface 33. This or these recesses 122 extends or extend, starting from a peripheral region 123 facing the interior 10 of the housing container 5, in the direction towards the shoulder 32, terminating at a distance 124 in front of the shoulder 32. The distance 124 may also be between 1.0 mm and 2.5 mm, preferably 1.5 mm, and thus correspond to the dimension 121. The sealing surface 33 on the stopper 48 extending continuously around the circumference is formed as a result.

Consequently by unscrewing the cap 20 slightly off the housing container 5 with the threads 42, 43 of the thread arrangement 40 still engaged, the stopper 48 can be pulled far enough out of the housing container 5 so that a flow connection is established between the interior 10 of the housing container 5 and the external ambient atmosphere again.

It is also possible to provide additional catch means between the shoulder 32, in particular its radially extending external surface, and the internal surface 41 of the cap casing 23 to prevent any mutual turning so that a joint displacement of the closure device 9 relative to the housing container 5 is always guaranteed, as schematically indicated in FIG. 24. These catch means may be provided in the form of complementary teeth, co-operating projections and cut-outs, or alternatively by a more coarse surface roughness, which may be combined with an additional radial pre-tensioning of the shoulder 32 where it is accommodated inside the cap casing 23.

Finally, it should be pointed out that the embodiments of the container system 1 described above are blood sample tubes, the interior 10 of which once closed by means of the closure device 9 is at a lower pressure than the ambient pressure of the site, in other words is evacuated. For certain applications, however, it may also be of advantage if the interior 10 is merely sterile or is filled with an active substance for treating the substance to be contained in it and is not evacuated. However, the active substance or substances only may be contained in the evacuated interior 10.

The embodiments illustrated as examples represent possible design variants of the container system 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the container system 1, it and its constituent parts such as the closure device 9 and housing container 5 are illustrated to a certain extent out of scale and/or on an enlarged scale and/or on a reduced scale.

The objective underlying the independent inventive solutions may be found in the description.

Above all, the individual embodiments illustrated in FIGS. 1, 2; 3, 4, 5; 6, 7, 8, 9; 10; 11, 12, 13, 14, 15, 16; 17; 18; 19; 20; 21; 22; 23, 24 constitute independent solutions proposed by the invention in their own right. The objectives and associated solutions proposed by the invention may be found in the detailed descriptions of these drawings.

LIST OF REFERENCE NUMBERS

1 Container system
2 Mixture
3 Medium
4 Medium
5 Housing container
6 End
7 End
8 End wall
9 Closure device
10 Interior
11 Container wall
12 Wall thickness
13 Dimension
14 Longitudinal axis
15 Plane
16 Plane
17 Dimension
18 Surface
19 End face
20 Cap
21 Sealing device
22 Seal stopper
23 Cap casing
24 Coupling part
25 Coupling part
26 Coupling part
27 Coupling part
28 Coupling mechanism
29 Projection
30 Projection
31 Retaining ring
32 Shoulder
33 Sealing surface
34 Sealing surface
35 Recess
36 Orifice
37 Coupling mechanism
38 End region
39 End region
40 Thread arrangement
41 Internal surface
42 Thread
43 Thread
44 Retaining mechanism
45 Support surface
46 Assembly unit
47 Thrust bearing
48 Stopper
49 Plane
50 Pitch angle
51 Thread beginning
52 Thread beginning
53 Thread Beginning
54 Thread beginning
55 Thread beginning
56 Thread beginning
57 Thread end
58 Thread end
59 Thread end
60 Pitch angle
61 Angle
62 Thread height
63 Thread outlet
64 Thread outlet
65 Transition radius
66 Base width
67 Radius
68 Apex width
69 Transition surface
70 Angle
71 Radius
72 Apex surface
73 Holder
74 Retaining plate
75 Positioning mechanism
76 Guide orifice
77 Separating device
78 Housing compartment
79 Retaining mechanism
80 Surface
81 Shoulder
82 Web
83 Positioning mechanism
84 Internal dimension
85 Abutment surface
86 Projection
87 Flow passage
88 Cut-out
89 Depth
90 Base surface
91 Boundary surface
92 Boundary surface
93 Transition surface
94 Transition surface
95 Longitudinal extension
96 Boundary surface
97 Boundary surface
98 Flow cross-section
99 Thread segment
100 Thread segment
101 Recess
102 Passage
103 Projection
104 Protectve element
105 Internal diameter
106 Rib
107 Holder
108 Coating element
109 Supply device
110 Container
111 Supply line
112 Metering element
113 Orifice
114 Pin
115 Recess
116 Sealing surface
117 Passage
118 Clearance width
119 Dimension
120 Oblique surface
121 Dimension
122 Recess
123 Peripheral region
124 Distance

The invention claimed is:

1. Method of assembling a container system for blood, body fluids, tissue parts, or tissue cultures, which container system has a closure device comprising a cap and a sealing device made from a pierceable, highly elastic and self-closing material which is inserted before said cap is screwed on, and a substantially cylindrical housing container enclosing an interior with an open end, whereby a cap casing of the cap extends around an open end face of the housing container by means of the cap having an open end region directed towards the housing container during the assembly process wherein the method comprises:

inserting a sealing surface of the sealing device in the open region of the interior of the housing container;

placing a thread arrangement with co-operating threads between the cap and the housing container; and creating a relative rotating or pivoting movement which is effected about a common longitudinal axis in order to assemble the closure device and the housing container, simultaneously assembling several closure devices with the housing containers to be joined to form the container system in a common assembly unit and prior to joining the components to be assembled the interiors of the housing containers are sealed off from the external atmosphere and are reduced to a pressure lower than the external ambient pressure and one of the components to be assembled is respectively supported on a thrust bearing of the assembly unit so as to be rotatable about its longitudinal axis for the joining operations, applying a pressing force (F) essentially axially along a longitudinal axis wherein the force is applied to at least one of the components to be assembled by the assembly unit;

converting the essentially axial pressing force (f) intended to generate a relative rotating or pivoting movement about the common longitudinal axis by the co-operating threads which are configured at a pitch angle to convert said essentially axial pressing force into said rotating or pivoting movement; and engaging the threads of the thread arrangement with one another across the entire length of the screwing in path until the fully screwed in portion is reached during the relative rotating or pivoting movement.

2. Method as claimed in claim 1, wherein the pressing force (F) is applied to the cap of the closure device.

3. Method as claimed in claim 1, wherein when the pressing force (F) is being applied, the cap is held stationary relative to the housing container and the housing container is displaced in the relative rotating or pivoting movement.

4. Method as claimed in claim 1, wherein the housing container is held stationary relative to the cap when the pressing force (F) is being applied.

5. Method as claimed in claim 1, wherein the relative rotating or pivoting movement is caused by the pressing force (F) with an intensity of between 10N and 50N.

6. Method as claimed in claim 1, wherein before applying the pressing force (F), one of the components to be assembled is pre-positioned relative to the other one of the components to be assembled by a free rotation about the common longitudinal axis.

7. A method of assembling a container system for blood, body fluids, tissue parts, or tissue cultures, which container system has a closure device comprising a cap and a sealing device and a substantially cylindrical housing container wherein the method comprises the following steps:

inserting a sealing surface of the sealing device in the open region of an interior of the housing container, wherein said sealing surface is made from a pierceable, highly elastic and self-closing material which is inserted before the cap is screwed on, wherein said sealing surface extends across an open face of the housing container;

reducing an internal pressure to a pressure lower than an external ambient pressure;

placing a cap on the housing end covered by the sealing surface, wherein the cap and the housing container have a thread arrangement with co-operating threads;

applying an essentially axial pressing force (F) essentially in a longitudinal axis wherein the force is applied to at least one of the components to be assembled by the assembly unit;

converting the essentially axial pressing force (F) intended to generate a relative rotating or pivoting movement about the common longitudinal axis by the co-operating threads;

creating a relative rotating or pivoting movement from said essentially axial pressing force acting on the co-operating threads, wherein the movement is effected about a common longitudinal axis in order to assemble the closure device and the housing container, and engaging the threads of the thread arrangement with one another across the entire length of the screwing in path until the fully screwed in portion is reached during the relative rotating or pivoting movement.

8. Method as claimed in claim 7, further comprising the step of applying a coating on at least one component forming the container system before the assembly process.

9. Method as claimed in claim 8, wherein the coating is applied to at least certain areas in the region of a coupling mechanism between the cap and the housing container.

10. Method as claimed in claim 8, wherein the coating is applied to the part of the thread arrangement disposed on the housing container.

11. Method as claimed in claim 8, wherein the coating is applied to the part of the thread arrangement disposed on the cap.

12. Method as claimed in claim 8, wherein the coating is applied to a sealing surface of a stopper of the sealing device directed towards the housing container.

13. Method as claimed in claim 8, wherein the coating is applied to an internal surface of the housing container facing the sealing surface of the stopper of the sealing device.

14. Method as claimed in claim 8, wherein the coating is applied to the respective coating region continuously or all over.

15. Method as claimed in claim 8, wherein the coating reduces friction between the components to be assembled in readiness for the joining operation.

* * * * *

UNITED STATES PATENT AND TRADEMARK OFFICE

CERTIFICATE OF CORRECTION

PATENT NO. : 8,448,800 B2
APPLICATION NO. : 10/586430
DATED : May 28, 2013
INVENTOR(S) : Franz Konrad It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1838 days.

Signed and Sealed this
Eighth Day of September, 2015

Michelle K. Lee

Michelle K. Lee
*Director of the United States Patent and Trademark Office*